US005291253A

United States Patent [19]

Kumasaka et al.

[11] Patent Number: 5,291,253

[45] Date of Patent: Mar. 1, 1994

[54] CORONA DETERIORATION AND MOISTURE COMPENSATION FOR TRANSFER UNIT IN AN ELECTROPHOTOGRAPHIC APPARATUS

[75] Inventors: Takao Kumasaka; Yuzuru Simazaki; Yasuo Takuma, all of Hitachi; Masato Yamada; Nobuyoshi Hoshi, both of Katsuta, all of Japan

[73] Assignees: Hitachi, Ltd.; Hitachi Koki Co., Ltd., both of Tokyo, Japan

[21] Appl. No.: 629,419

[22] Filed: Dec. 18, 1990

[30] Foreign Application Priority Data

| | | | |
|---|---|---|---|
| Dec. 20, 1989 | [JP] | Japan | 1-328500 |
| Feb. 21, 1990 | [JP] | Japan | 2-038236 |
| Mar. 13, 1990 | [JP] | Japan | 2-060017 |

[51] Int. Cl.[5] ..... G03G 15/14

[52] U.S. Cl. ..... 355/275; 355/208; 355/274; 355/30; 355/271

[58] Field of Search ..... 355/203, 208, 215, 221, 355/272, 273, 274, 275, 311, 271, 326

[56] References Cited

U.S. PATENT DOCUMENTS

| | | | |
|---|---|---|---|
| 3,642,362 | 2/1972 | Mueller | 355/309 |
| 3,837,741 | 9/1974 | Spencer | 355/274 |
| 4,076,407 | 2/1978 | Place, Jr. | 355/274 |
| 4,134,147 | 1/1979 | Watanabe | 355/272 X |
| 4,401,383 | 8/1983 | Suzuki et al. | 355/272 |
| 4,676,627 | 6/1987 | Ohno | 355/221 |
| 4,772,918 | 9/1988 | Karasawa et al. | 355/274 |
| 4,912,515 | 3/1990 | Amemiya et al. | 355/274 |
| 5,036,360 | 7/1991 | Paxon et al. | 355/274 X |

FOREIGN PATENT DOCUMENTS

| | | |
|---|---|---|
| 54-58034 | 10/1979 | Japan . |
| 0057858 | 4/1980 | Japan . |
| 0036658 | 4/1981 | Japan . |
| 0025677 | 2/1983 | Japan . |
| 59-184377 | 10/1984 | Japan . |
| 60-57364 | 4/1985 | Japan . |
| 0050782 | 3/1987 | Japan . |
| 63-83765 | 4/1988 | Japan . |
| 2-163778 | 6/1990 | Japan . |
| 0212872 | 8/1990 | Japan . |

*Primary Examiner*—Benjamin R. Fuller
*Assistant Examiner*—J. E. Barlow, Jr.
*Attorney, Agent, or Firm*—Kenyon & Kenyon

[57] ABSTRACT

A transfer apparatus for electrophotography is disclosed in which the resistance values of a transfer belt and the recording paper are measured, and the current value applied to a device for charging a member is set on the basis of the electrical resistance values. The charging device of the transfer belt is adapted to be taken up and reeled out and to circulate along a track. This configuration assures a stable transfer characteristic against the secular environmental variations of the component elements, lengthens the intervals of replacement of the charged member, and hence increases the mechanical life of the transfer apparatus and the electrophotographic apparatus using the same.

22 Claims, 17 Drawing Sheets

LOW-DENSITY IMAGE

HIGH-DENSITY IMAGE OR COLOR SUPERIMPOSITION

CORONA DETERIORATION AND MOISTURE COMPENSATION FOR TRANSFER UNIT IN AN ELECTROPHOTOGRAPHIC APPARATUS

BACKGROUND OF THE INVENTION

The present invention relates to a transfer apparatus for transferring a toner image formed within an electrophotographic apparatus onto the recording paper or the like transfer medium.

The electrophotographic apparatus is basically configured as follows: First, the surface of a photoconductor is uniformly charged, an electrostatic latent image corresponding to the image to be recorded is formed by exposing the surface of this photoconductor, the electrostatic latent image is developed to form a toner image, and the toner image thus formed is transferred to and fixed on the recording paper.

In the aforementioned processes, a well-known transfer means for transferring the toner image attached on the surface of the photoconductor to the recording paper is divided into contact-type transfer means for performing the transfer operation by electrostatic force with a member charged with electrons (the charged member) kept in contact with the recording paper, and transfer means of non-contact type for performing the transfer operation free of contact with the recording paper.

The transfer means of contact type is classified into the belt transfer system and the roller transfer system by the type of the charged member.

The transfer means of non-contact type, on the other hand, includes a corona transfer system in which a corona ion flow is irradiated directly on the back of the recording paper to which it is desired to transfer toner image.

Of all the transfer systems described above, the belt transfer means, as disclosed in U.S. Pat. No. 3,642,362, JP-A-54-58034 and JP-A-63-83765, is so constructed that the recording paper is transported to a photoconductor portion having a toner image formed thereon, and a dielectric belt charged in the polarity opposite to that of the toner charges is pressed against the photoconductor member portion from the back of the transported recording paper (the side of the recording paper far from the photoconductor member) thereby to transfer the toner image attached on the photoconductor member portion to the surface of the recording paper. A corona charger is used as the above-mentioned means for charging the dielectric belt.

Another example of the construction for belt transfer is embodied by the belt transfer means disclosed in JP-A-59-184377. In this transfer means, an endless transfer belt adapted to rotate with a portion thereof kept in contact with the surface of a photoconductor has the surface thereof charged in advance, and the recording paper is pressed (in close contact) against the surface of the photoconductor while being adsorbed electrostatically to the surface of the transfer belt, thereby transferring the toner image.

The belt transfer system in which the recording paper is pressed against the surface of the photoconductor has the advantage of a high transferability to the thick or rough-surface paper as compared with the corona transfer system described above.

In the aforementioned prior-art systems, the corona transfer system is such that in the case where the recording paper is thick or a portion of the recording paper is deformed, there causes a gap between the recording paper and the photoconductor member. As a result, the distance of movement (transfer) of the toner image is lengthened, so that toner particles are undesirably scattered, thereby leading to the shortcoming of making it impossible to produce a clear transfer image (transfer a clear toner image to the recording paper).

According to the belt transfer system, on the other hand, if the belt material or the recording paper becomes humid under an environment of high humidity and the electrical resistance value thereof decreases, the intensity of the electric field of the transfer position (contact spot between the recording paper and the photoconductor member) increases excessively. This causes a charge current to flow through a guide for transporting the recording paper or the belt drive roller, with the result that the quality of the transfer image or the transfer efficiency is deteriorated. Further, if the dielectric belt is irradiated with the corona discharge for a long time, the surface layer of the belt deteriorates in quality and the electrical resistance of the belt is reduced. Thus the electric charges are liable to leak out and thereby, to have an adverse effect on the charge-holding characteristic.

This effect will be explained with reference to the graph shown in FIG. 21. As seen from FIG. 21, in the case of a high ambient humidity or a long printing operation, the transfer efficiency is deteriorated so that image density is reduced.

The transfer efficiency is given as an evaluation function $\eta$ defined by equation (1) below.

$$\eta = \frac{\text{Image density transferred to paper}}{\text{Image density on photoconductor member before transfer}} \times 100(\%) \quad (1)$$

As a measure for solving the problem of a reduced transfer efficiency or image density, the technique for monitoring the surface potential of the belt and setting it to a predetermined value is disclosed in JP-A-60-57364. The surface potential of the belt, however, is a physical quantity dependent on the resistance value of the belt surface, and therefore the belt surface potential monitored is not a physical quantity reflecting the resistance value of the recording paper.

Also, the transfer belt, which is worn by contact with the recording paper or the photoconductor and is deteriorated in electrical characteristics by the ozone generated from the charger, is required to be replaced at short intervals of time. This takes extra labor of the user and makes the operation troublesome.

SUMMARY OF THE INVENTION

A first object of the present invention is to solve the above-mentioned problems of the prior art and to provide a transfer apparatus for electrophotography and an electrophotographic apparatus which are capable of stable printing with the transfer performances thereof remaining unchanged with a change in the ambient conditions to which the electrophotographic apparatus is exposed or with secular variations of the belt material.

A second object of the present invention is to provide means for using the belt as a charged member continuously for a long period of time without being replaced.

In order to achieve the first object described above, there are used according to the present invention the following-listed means:

(1) Means for evaluating the electric resistance value of charged members such as a belt material and a roller and the paper, and control means for changing the discharge current of a transfer charger on the basis of the output of the evaluation means;

(2) Means for measuring or recognizing the electrical resistance value of the recording paper equivalently by a humidity sensor, in the case where the evaluation means stands in the way of transportation on the paper transportation path of the transfer unit;

(3) Means for defining the range of change in the resistance value of the charged members with humidity in advance and controlling the current produced from the charging means; or (4) Protective means for preventing the deterioration by charge or discharge on the side of the charged members near to the charging means (a transfer charger and an antistatic roller).

In this configuration, even if the electrical resistance value of the charged members or the recording paper undergoes a change, the current of the charging means (such as the transfer charger or a bias roll) is changed thereby to secure an operation with a superior transfer characteristic.

In order to achieve the aforementioned second object, the present invention comprises:

(1) Means for moving an exposed portion of a belt tensioned between belt take-up means and belt supply means together with the belt take-up means and the belt supply means along a specific track;

(2) Belt drive means for driving an exposed portion of a belt tensioned between belt take-up means and belt supply means together with the belt take-up means and the belt supply means along a specific track, an electrophotographic photoconductor arranged in contact with the track on the surface of the exposed belt portion, means for forming a toner image on the photoconductor surface, means for absorbing the recording paper electrostatically to the belt surface, and means for bringing the recording paper adsorbed on the belt surface into contact with the electrophotographic photoconductor and transferring the toner image on the surface of the electrophotographic photoconductor to the recording paper; or (3) Belt drive means for driving an exposed portion of a photoconductive belt tensioned between belt take-up means and belt supply means together with the belt take-up means and the belt supply means along a specific track, means for forming a toner image on the surface of the exposed portion of the photoconductive belt, and means for bringing the recording paper into contact with the surface of the photoconductive belt thereby to transfer the toner image on the photoconductive surface to the recording paper.

In the above-mentioned configuration, if the exposed portion of the belt tensioned between the belt take-up means and the belt supply means is deteriorated, an unused belt portion accommodated in the belt supply means may be exposed between the belt supply means and the belt take-up means by taking up the deteriorated exposed portion into the take-up means, thus making it possible to renew the used belt portion (exposed portion) in the same manner as if replaced.

DESCRIPTION OF THE PREFERRED EMBODIMENTS

Explanation will be made below about means for achieving the first object with reference to embodiments shown in FIGS. 1 to 29.

Figure 1:
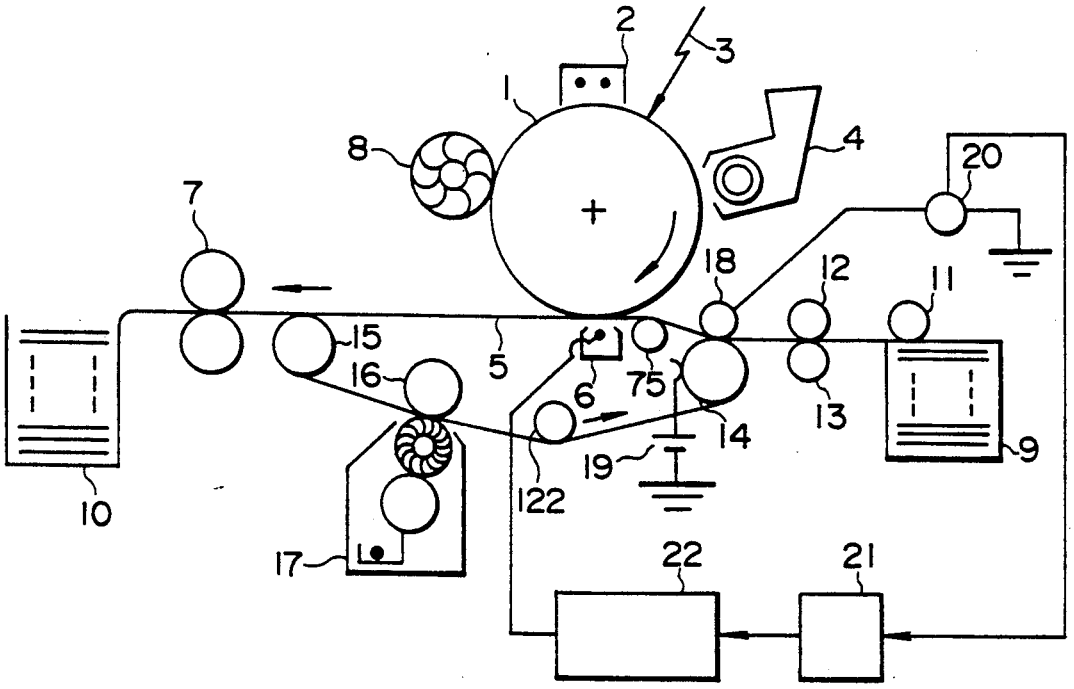
FIG. 1 is a longitudinal sectional view showing an embodiment of the present invention.

Embodiment 1:

A first embodiment of the present invention is shown in FIG. 1. A configuration providing a prerequisite is embodied by a belt transfer means comprising a light-sensitive member 1 including a charger 2, an exposure unit 3 and a developer 4 arranged therearound, a transfer belt 5 and a transfer charger 6 for charging the transfer belt 5 and transferring a toner image onto the paper. In this transfer means, (1) the bearing of a belt transport roller 14 on a paper-feed side is insulated and made chargeable by a resistance-measuring power supply 19, while an opposite roller 18 grounded through an ampere meter 20 is pressed into contact with the transport roller 14 with the transport belt 5 therebetween at the same time, and (2) control signal generation means 21 for generating a control signal on the basis of an output signal from the ampere meter 20 is interposed in the first stage of a high-voltage power supply 22 of the transfer charger 6.

With regard to the reference numerals other than described above in FIG. 1, reference numeral 7 designates heat rolls, numeral 8 a cleaner, numeral 9 a paper hopper, numeral 10 a paper stacker, numeral 11 a paper pick roller, numerals 12 and 13 paper feed rollers, numeral 15 a belt drive roller, numeral 16 a roller opposite to a belt cleaner 17, and numeral 18 an opposite roller. And, numeral 122 designates a roller for adjusting the tension of the transfer belt 5.

In this configuration, the current with a predetermined potential applied to a member (the transfer belt 5 and/or the recording paper) interposed between a pair of rollers 14, 18 is capable of being measured by the ampere meter 20, and therefore it is possible to evaluate the electrical resistance value of a corresponding member. A circuit for converting the current value making up an output signal of the ampere meter into an electrical resistance value may be built in the ampere meter 20 or may be arranged on the control signal generation means 21. Further, the control signal generation means may generate a high-voltage power control signal for maintaining the relationship between a predetermined electrical resistance of the transfer means and the corona discharge current of the transfer charger 6 thereby to control the output current of the high-voltage power supply 22.

Figure 22:
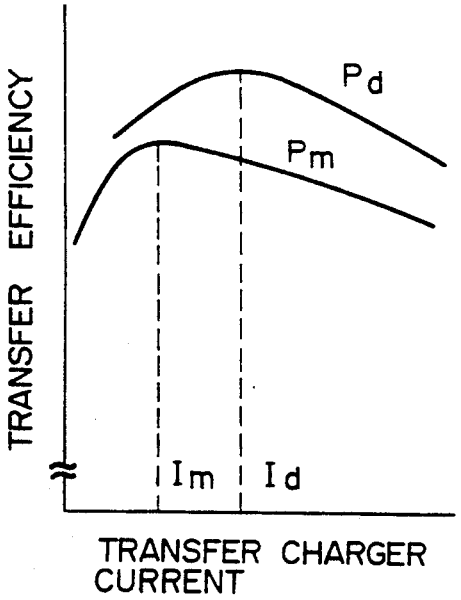
FIGS. 22 and 23 are diagrams for explaining the relationship between the transfer charger current and the transfer efficiency in initial stage and after approximately 100 hours of printing, respectively.
Figure 23:
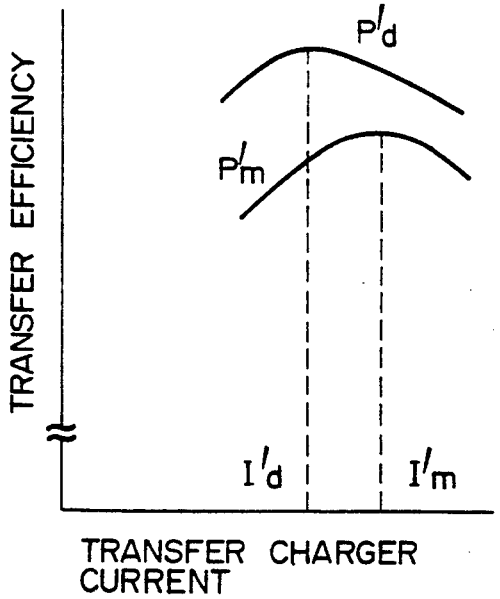
Figure 24:
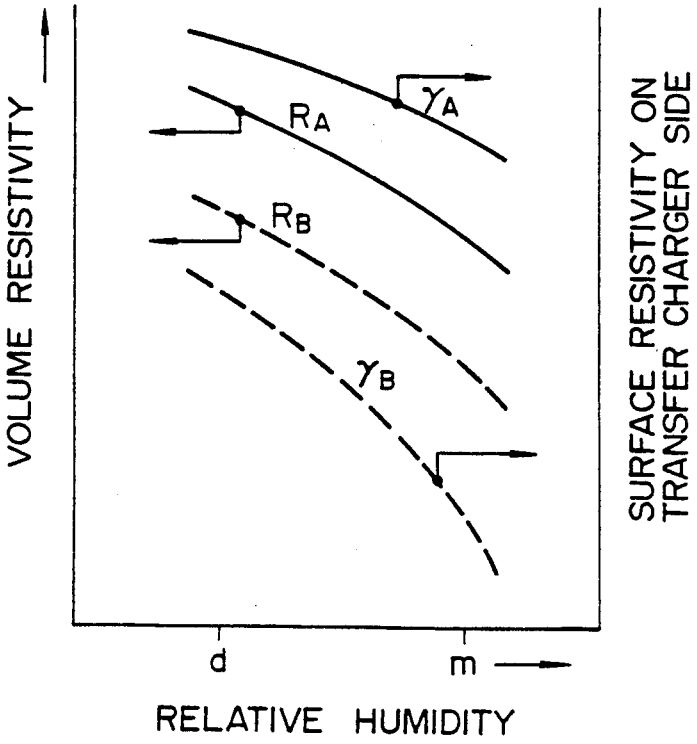
FIG. 24 is a diagram for explaining the relationship between relative humidity and the electrical resistivity of a transfer belt.

On the other hand, an experiment conducted by the inventors shows (1) that as shown in FIG. 22, the value of the transfer charge current associated with the maximum transfer efficiency is different between high and low humidities even in initial stages, (2) that as shown in FIG. 23 after the printing of approximately 100 hours, the value of the transfer charger current associated with the maximum transfer efficiency is different from that in initial stages (See FIG. 22), and (3) that the phenomena described in (1) and (2) are caused by the fact that as shown in FIG. 24, the resistance value of the belt is dependent on humidity or deterioration of the surface layer by corona irradiations thereby reducing the electrical resistance thereof.

According to the present embodiment, therefore, the current value of the transfer charger is capable of being controlled to a proper value, thus assuring a satisfactory transfer characteristic, in any of the cases (1) to (3) described below.

(1) In the case where the environmental conditions are changed, thereby changing the electrical resistance value of the transfer belt or the paper.

(2) In the case where the electrical resistance value of the transfer belt is subjected to secular variations due to the corona charging or a change in the conditions of the surface layer resulting from toner filming or wear.

(3) In the case where the electrical resistance value of the paper varies from one paper to another or is dependent on the printing conditions (for either one- or two-side printing) or storage conditions even for the same paper.

Figure 21:
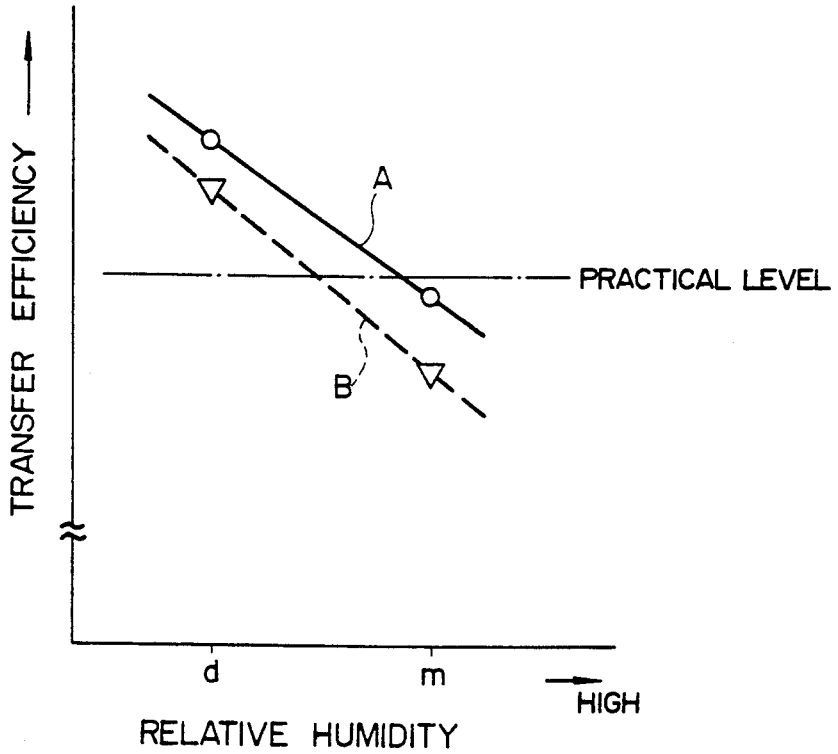
FIG. 21 is a diagram for explaining the relationship between the relative humidity and the transfer efficiency of a conventional apparatus.
Figure 25:
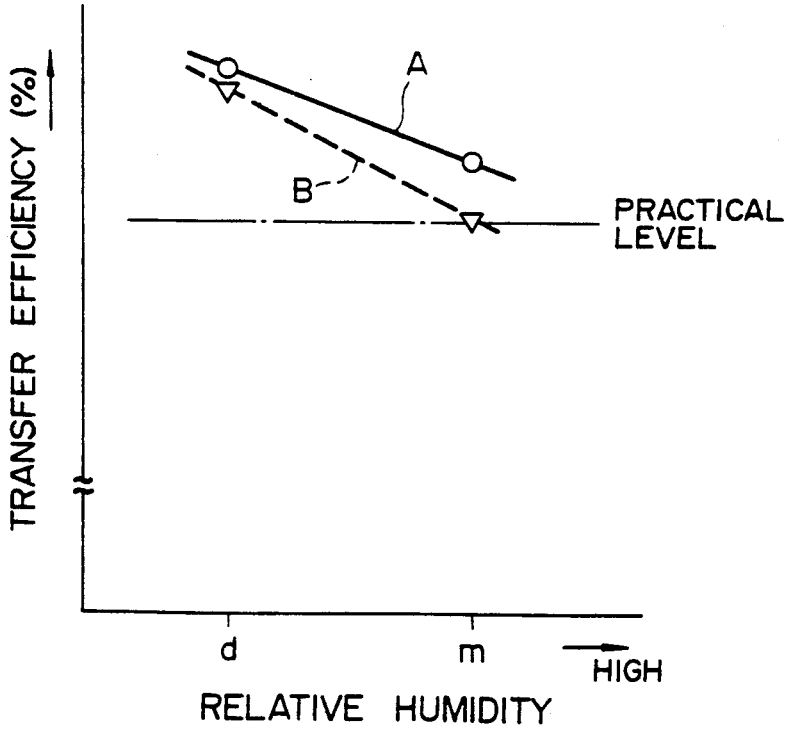
FIG. 25 is a diagram for explaining the relationship between relative humidity and transfer efficiency according to the present invention.

As an example, FIG. 25 shows the relationship between relative humidity and transfer efficiency in the case where the present invention is embodied under the same conditions (relating to the belt material, the configuration of the transfer charger, humidity and the printing time) as in FIG. 21. As compared with FIG. 21, it is seen that the range of change in transfer efficiency with secular variations due to corona deterioration or humidity change is reduced for a stabilized transfer characteristic.

The power supply 19 for measuring the electrical resistance may be used for spare charging of the belt 5 even if the electrical resistance is not measured, thereby further improving the transportation and transfer characteristics of the paper under high humidity.

Figure 2:
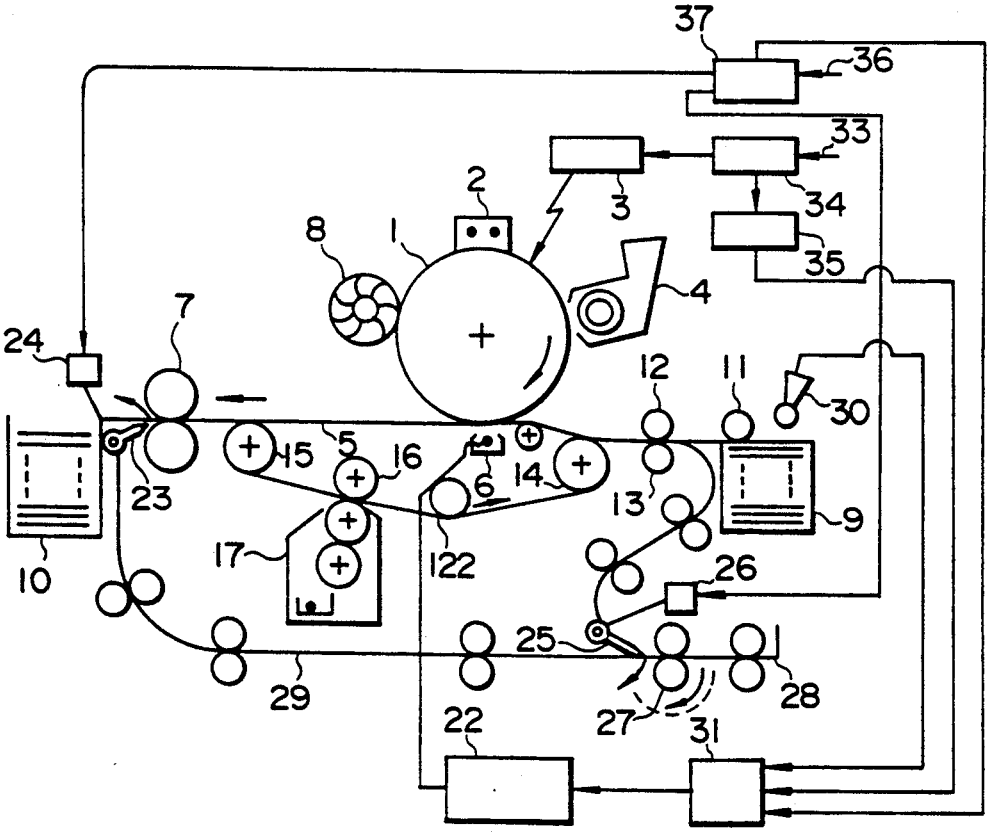
FIGS. 2 to 5 are sectional views showing other embodiments of the present invention.

Embodiment 2:

FIG. 2 is a diagram showing a second embodiment. This embodiment is different from the first embodiment in that under the present embodiment, a humidity sensor 30 is used in place of the means for measuring the electrical resistance directly unlike in the first embodiment. In the case under consideration, the resistance value of the member to which an image is transferred is determined indirectly by the method mentioned below thereby to control the corona discharge current value of the transfer charger 6. First, (1) the relationship between humidity, printing mode (one- or two-side printing) and the electrical resistance of the paper is determined in advance, and humidity is measured. Once the information on paper quality and printing mode are determined, the electrical resistance value of a corresponding paper is capable of being specified. (2) Since the characteristic of deterioration with time and the humidity dependency are measured in advance, the change in electrical resistance of the transfer belt is capable of being forecast by counting the operation time of the transfer charger or the number of pages printed.

As to the input of data on the electrical resistance of the paper and the transfer belt, it may be inputted from time to time, or may be applied to external memory means such as a microcomputer, ROM card or floppy disc in the control signal generation means 22. The printing mode is determined by applying a printing mode signal to the control signal generation means 31.

The thickness of the paper, on the other hand, may be taken into consideration by being detected by a distance sensor, a displacement sensor or the like at the time of setting the paper in the paper hopper or during the feeding of the paper, and by applying a signal corresponding to the paper thickness to the control signal generation means 31.

According to the second embodiment, the evaluation accuracy of the electrical resistance value of the transfer member is liable to be lower than in the first embodiment shown in FIG. 1. In view of the fact that there is no need of providing means for measuring the electrical resistance around the transfer belt 5, however, the transfer unit is capable of being reduced in size and the configuration simplified.

FIGS. 3 to 17 are diagrams showing embodiments relating to a means and method of measuring the electrical resistance, and will be explained sequentially below.

Figure 3:
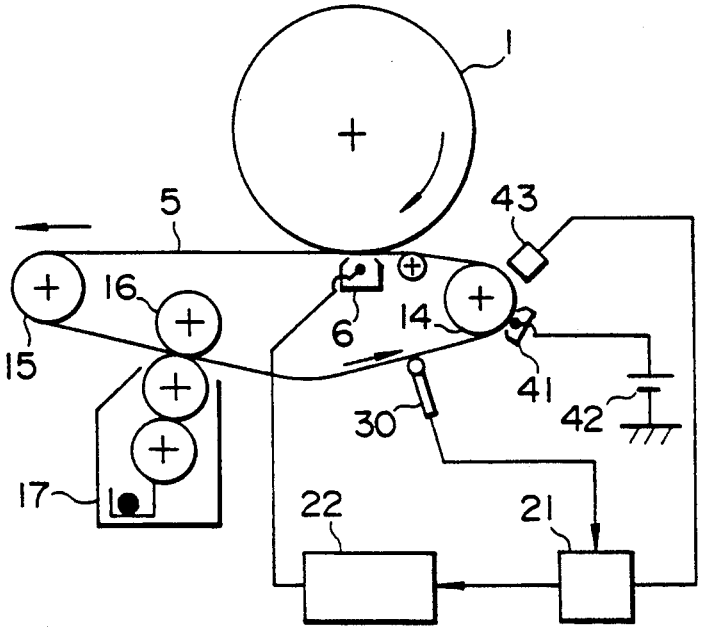

Embodiment 3:

FIG. 3 is a diagram showing a third embodiment for explaining a method of measuring the resistance value on the basis of the surface potential of the belt surface by charging the transfer belt. An auxiliary charger 41 corresponding to the transport roller 14 is provided, and the transfer belt 5 is charged. The charge voltage is measured by the surface potential meter 43, and the resistance value of the transfer belt is evaluated accordingly. As compared with the first embodiment of contact type, the embodiment under consideration has the effect of preventing the wearing of the transfer belt 5 which otherwise might be caused by sliding friction with the rollers due to the availability of non-contact measurement.

Figure 4:
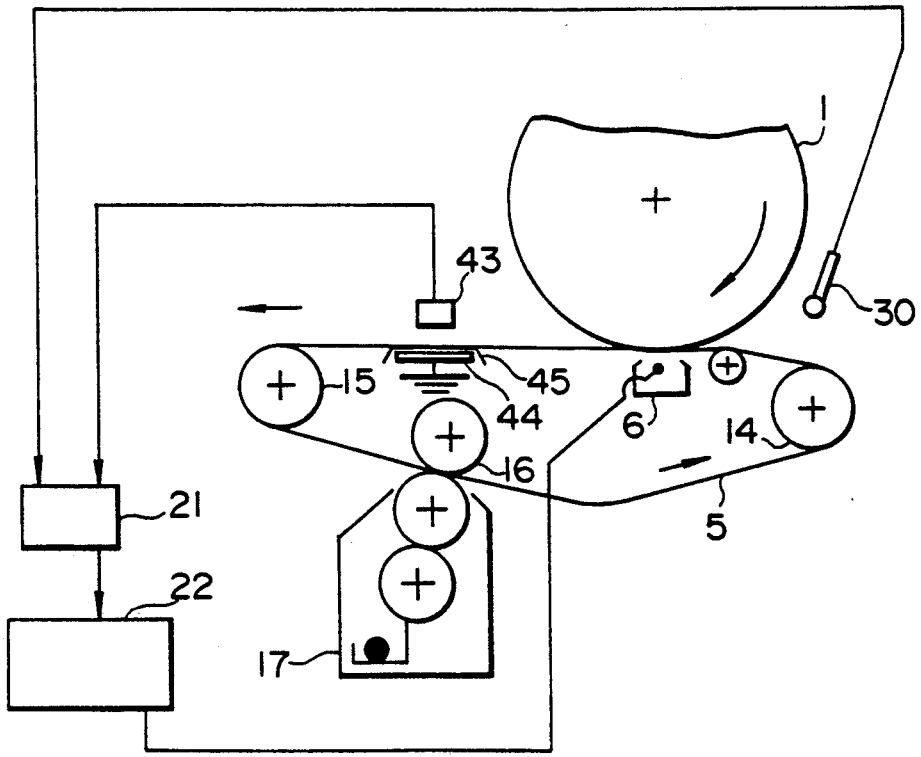

Embodiment 4:

FIG. 4 is a diagram showing a fourth embodiment of the present invention. In this embodiment, a grounding electrode 44 having an insulating film 45 is arranged in such a manner as to be capable of measuring the charge potential of the transfer belt 5 due to the transfer charger 6, with a surface potential meter 43 disposed at an opposite position. The insulating film 45 is not always necessary and may be replaced by an air layer. According to the embodiment under consideration, as compared with the third embodiment shown in FIG. 3, there is no need of the auxiliary charger 41, and it is possible to eliminate the effect of auxiliary charge on the transfer operation.

Figure 5:
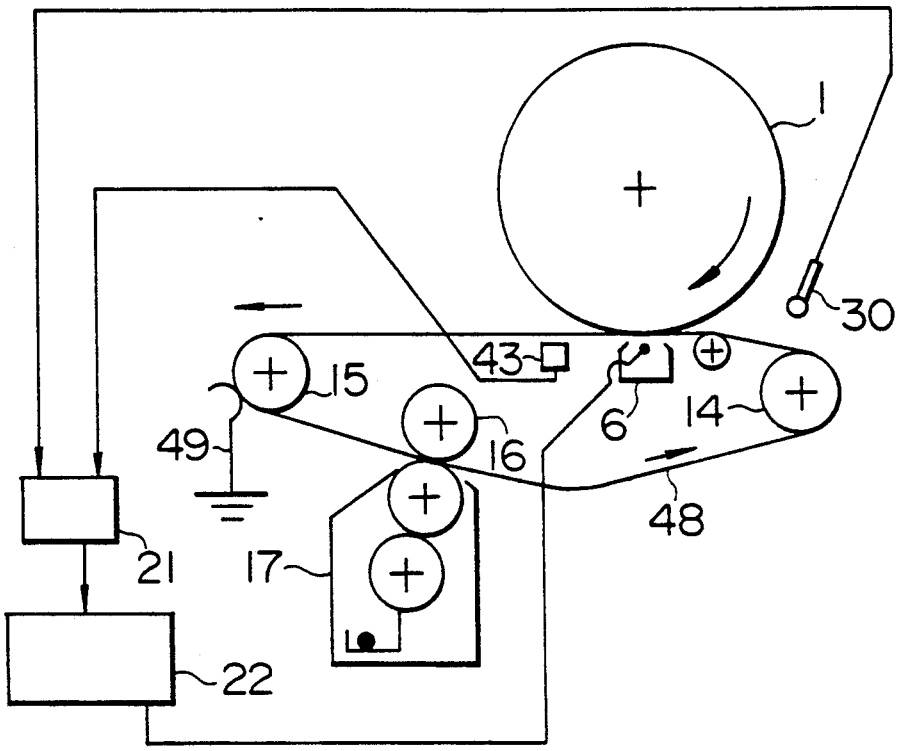

Embodiment 5:

A fifth embodiment of the invention is shown in FIG. 5. This embodiment represents a method of evaluating the electrical resistance value of the belt by measuring the potential of a transfer belt 48 on the back thereof.

Figure 6:
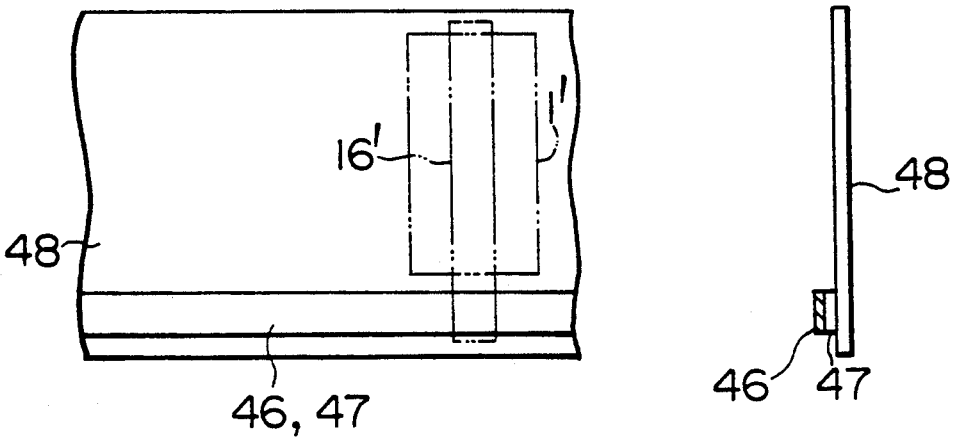
FIG. 6 is a diagram for explaining a transfer belt used for the embodiment shown in FIG. 5.

Embodiment 6:

FIG. 6 is a diagram showing a configuration of the transfer belt used for this measurement described in Embodiment 5. The transfer belt 48 is configured by arranging a thin insulating layer 47 and a conductor 46 off the position of a photoconductor member 1' along the width thereof, and as shown in FIG. 6, the conductor 46 is grounded by grounding means 49 thereby to form a grounding electrode. With the surface potential meter 43 arranged at a position opposite to the conductor 46, the surface potential of the transfer belt 48 is adapted to be measured from the reverse side thereof. In the embodiment under consideration, it is not necessary to attach a member at a position corresponding to the photoconductor member 1' (printing area) in contact with the transfer belt 48, and therefore the wear of the transfer belt or damage thereof due to discharge is eliminated on the one hand, and the fact that the surface potential meter 43 may be disposed in the vicinity of the transfer charger 6 improves the measurement accuracy on the other.

Figure 7:
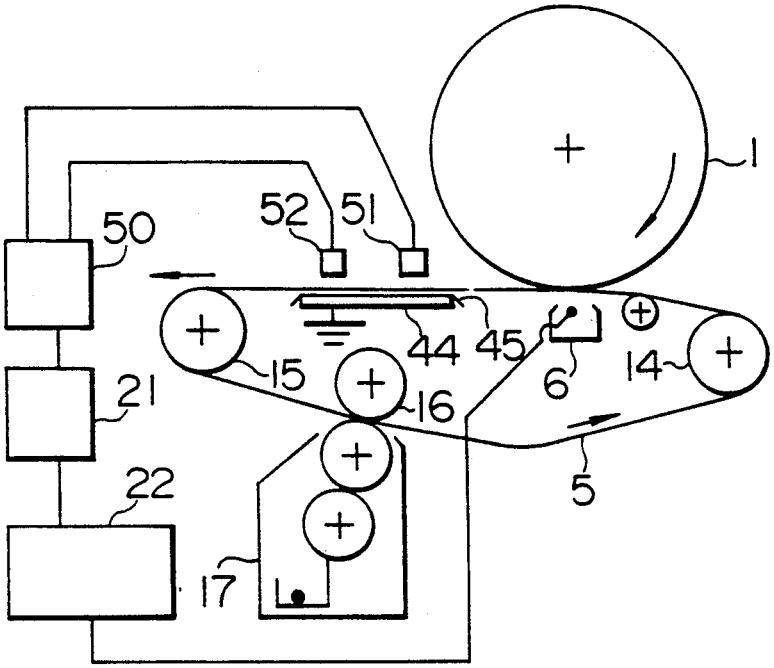
FIGS. 7 to 17, 19 and 20 are longitudinal sectional views showing still other embodiments of the present invention.

Embodiment 7:

A seventh embodiment is shown in FIG. 7. This embodiment, which may be considered a modification from the fourth embodiment, comprises at least two surface potential meters 51, 52 for measuring the potential attenuation rate, on the basis of which the current value of the transfer charger 6 is controlled. As compared with the fourth embodiment, the present embodiment has the advantage that measurement of still higher accuracy is possible even when the resistance and the electrostatic capacity of the insulating layer between the belt 5 and the grounding electrode 44 undergo a change.

Figure 8:
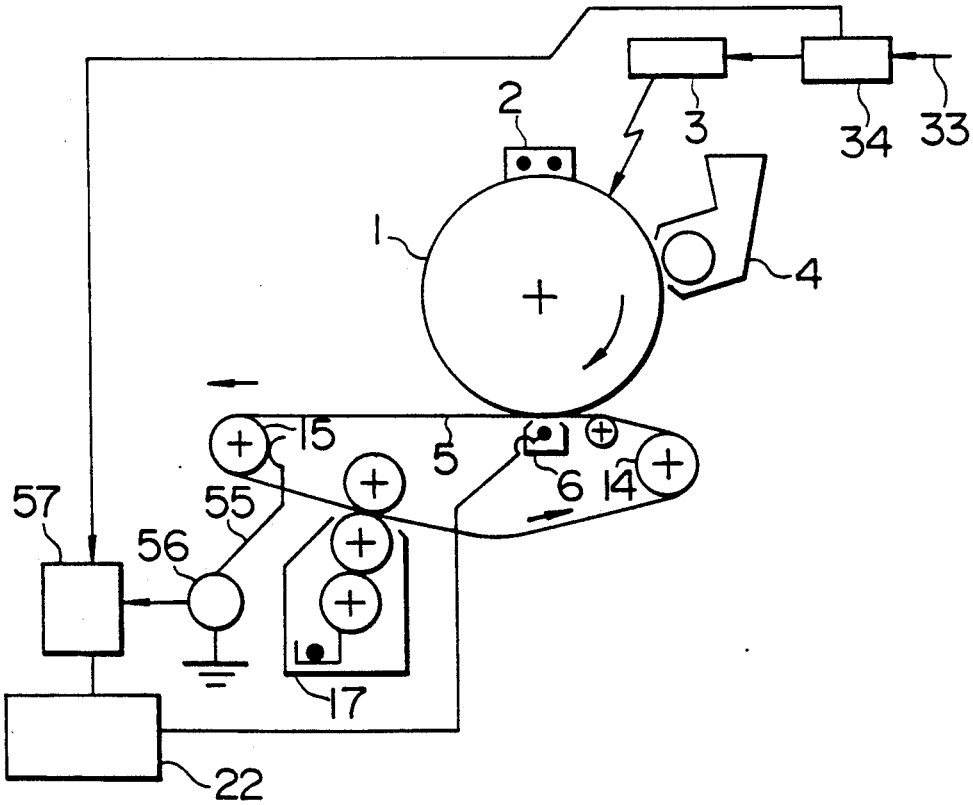

Embodiment 8:

An eighth embodiment of the invention is shown in FIG. 8. This embodiment is configured in such a manner that a printing signal pattern is applied to control signal generation means 57 thereby to perform the measurement of electrical resistance under predetermined printing conditions. Electrical resistance of the transfer belt is evaluated by the current flowing into the transfer belt drive roller 15. Instead of measuring the current flowing into the transfer belt drive roller 15 on the outlet side as in the present embodiment, the means for measuring the electrical resistance such as shown in FIG. 1 or 3 may be used with equal effect. According to the present embodiment, the electrical resistance is capable of being measured under fixed measurement conditions on the photoconductor member 1 side, and therefore the measurement accuracy is improved over the various embodiments described above.

Figure 9:
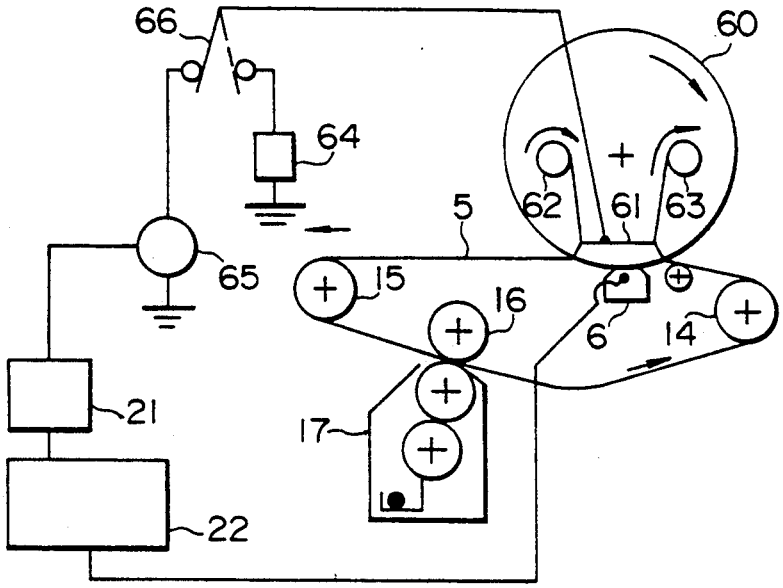

Embodiment 9:

FIG. 9 is a diagram showing a ninth embodiment representing a method of measuring the electrical resistance in the case of using a photoconductor drum 60 of sheet take-up type.

A photoconductive sheet is wound around the photoconductor drum 60.

When the photoconductive sheet is degraded, the photoconductive sheet is delivered from a delivery roller 62, and the photoconductive sheet is taken up so that there may not be generated any deflection at the photoconductive sheet wound around the photoconductor drum 60 by means of a take-up roller 63. The current flowing into a cap 61 of the photoconductor member arranged at a take-up port is measured, and the resistance value is evaluated from the relationship between the electrical resistance value of the transfer belt 5 measured in advance and the current flowing into the cap 61, so that the current of the transfer charger 6 is controlled on the basis of the resistance value thus evaluated. The cap 61 is held to substantially the same potential level as the surface potential of the photoconductor member 60 by potential holding means 64 with a change-over switch 66 connected to the dashed-line side in ordinary printing mode, and is connected to an ampere meter 65 side through the change-over switch at the time of measuring the electrical resistance. According to the present embodiment, the electrical resistance of the transfer belt 5 and/or the paper on the transfer means is capable of being measured, and therefore not only the measurement accuracy is improved but also an even better printing quality is achieved at the same time.

Although the current flowing into the photoconductor member is measured directly according to the embodiment shown in FIG. 9, the corona discharge current of the transfer charger and the current flowing into the shield case of the transfer charger may also be measured at the same time to determine the current flowing into the photoconductor member from the difference therebetween. In such a case, it is not necessary to ground the cap 61 of the light-sensitive member, thus leading to the advantage that the need of the change-over switch 66 and the grounding means is eliminated.

Figure 10:
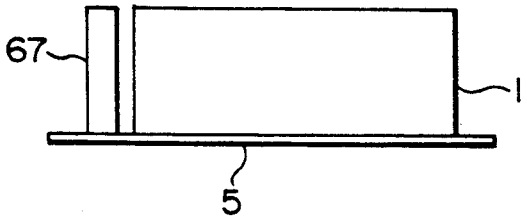
Figure 11:
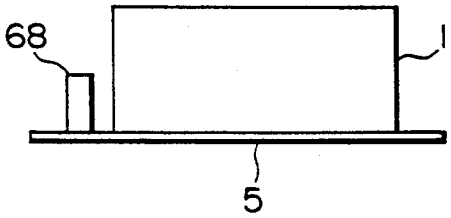
Figure 12:
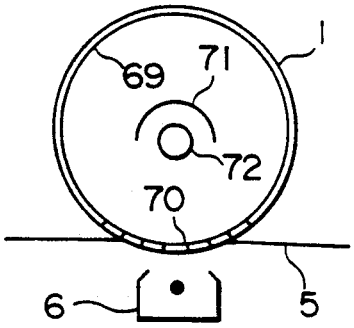
Figure 13:
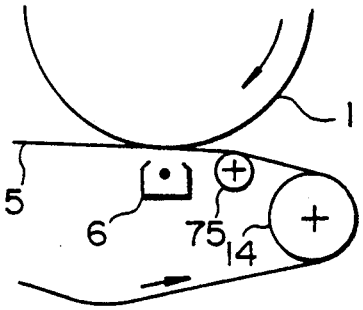

Embodiment 10:

FIGS. 10 and 11 are diagrams showing a tenth embodiment of the present invention. This embodiment is so configured that a measurement electrode is disposed in the vicinity of the photoconductor member. First, disc electrodes 67, 68 have a diameter identical to and different from the light-sensitive member respectively. Also, as shown in FIG. 12, a part of the photoconductor member may alternatively be configured of a transparent conductive material 70, so that the light-sensitive member is converted into a conductor by being irradiated with light by means of a light-emitting member 72 at the time of measuring the electrical resistance, and is used as a measurement electrode. As another alternative, as shown in FIG. 13, a push-up roller 75 may be used as a measurement electrode for bringing the transfer belt 5 into close contact with the photoconductor member 1.

Figure 14:
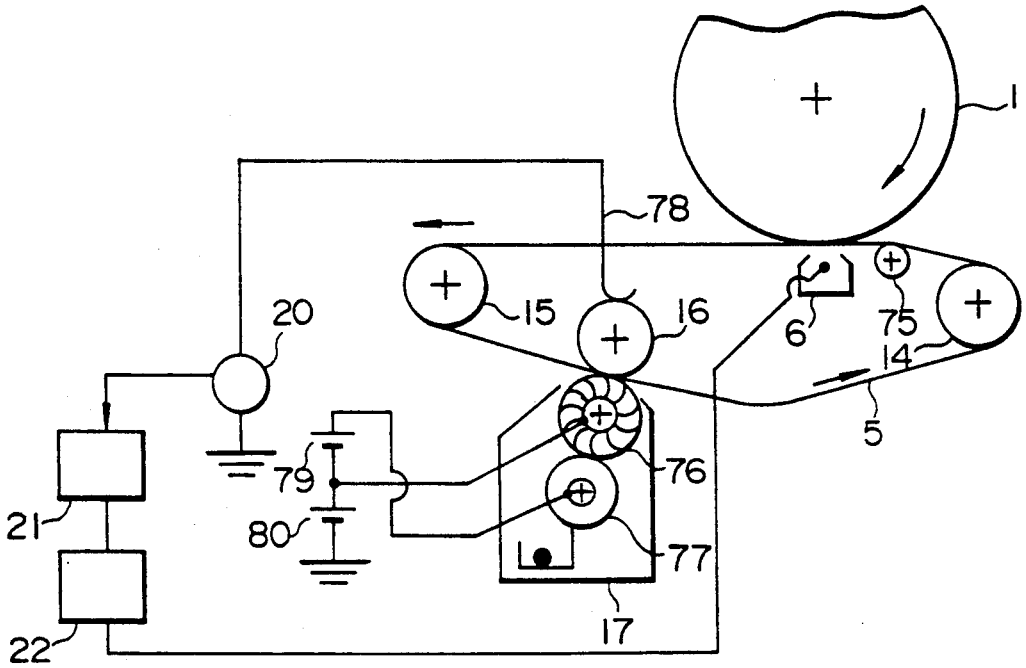

Embodiment 11:

FIG. 14 is a diagram showing an eleventh embodiment, which is so constructed that the current flowing into the opposite roller 16 of the bias cleaner 17 is measured to control the current of the transfer charger 6. As compared with the embodiments mentioned above, the present embodiment has the advantage that the electrical resistance of the transfer belt 5 is capable of being measured without adding any new member.

Figure 15:
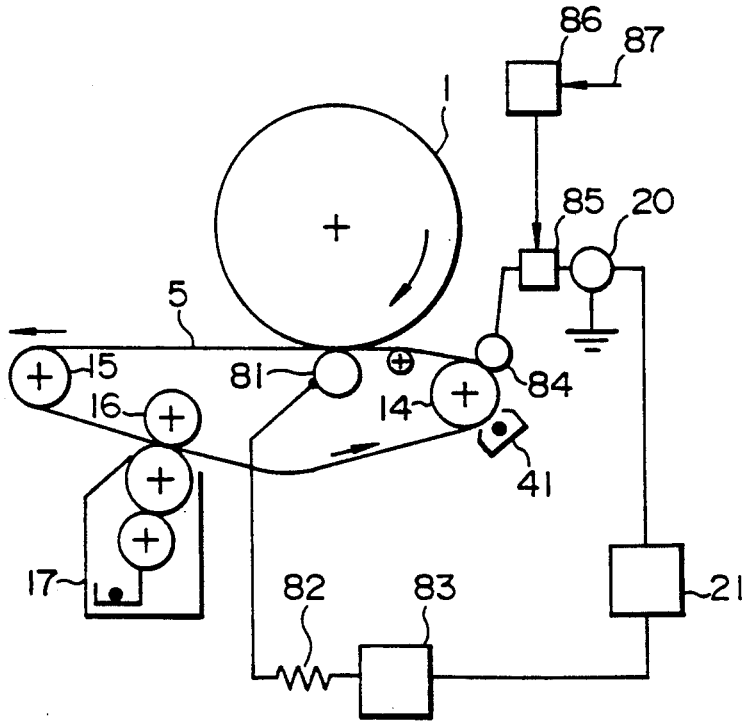

Embodiment 12:

FIG. 15 is a diagram showing a twelfth embodiment. The feature of this embodiment lies in that a resistor 85 is inserted between a paper-adsorbing/resistance-measuring roller 84 and an ampere meter 20 to change the resistance value between the ordinary printing mode and the measurement of electrical resistance. The present embodiment has the advantage that the paper-adsorbing means may be used as resistance-measuring means at the same time.

The bias roll 81 connected with the additional resistor 82 connected to a power supply 83 for bias roll charge, as charging means in FIG. 15 may be replaced with equal effect by a transfer charger 6 for corona discharge as described in the foregoing embodiment.

Figure 16:
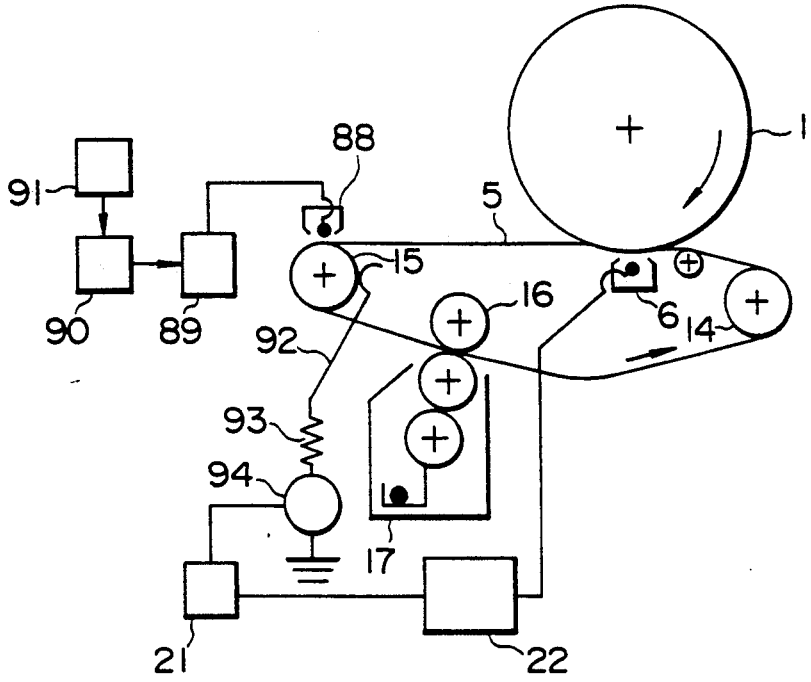

Embodiment 13:

FIG. 16 is a diagram showing a thirteenth embodiment configured in such a manner that a charger is arranged on the drive roller 15 side of the transfer belt 5 to measure the electrical resistance. More specifically, an AC antistatic device 88 is arranged in opposition to the drive roller 15, so that in normal printing mode, the paper is subjected to antistatic process, while at the time of measuring the electrical resistance, the apparatus is set anew to a predetermined AC discharge current value or is set to a DC discharge current value. In, this way, the current flowing into the drive roller 15 is measured, and the current flowing into the transfer charger 6 is controlled in accordance with the measurement of the current flowing into the drive roller 15. According to the present embodiment, a power supply 89 of a charger 88 for measuring the resistance is rather large in size, although the advantage is that the electrical resistance is capable of being measured without adding any new component parts around the transfer belt 5. Moreover, the resistor 93 is arranged lower than the electrical resistance of the transfer belt.

Figure 17:
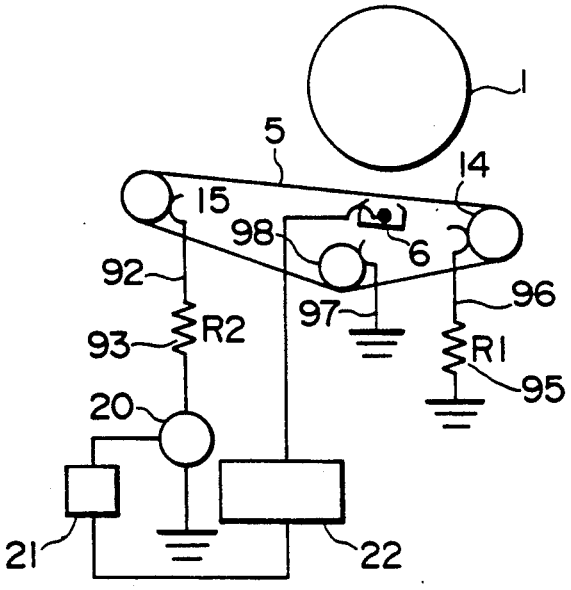

Embodiment 14:

FIG. 17 is a diagram showing a fourteenth embodiment. A resistor is added to a transport roller 14 providing a support of the transfer belt and also to a drive roller 15 respectively to assure a predetermined value of electrical resistance of the drive roller and the transport roller against the earth. The transport roller 14 thus has a resistor 95 with a resistance value R1 added thereto in series with a contact material 96 and grounded, while the drive roller 15 making up means for measuring the electrical resistance is grounded through the contract material 92, a resistor 93 having a resistance value of R2 and an ampere meter 20. Furthermore, a roller 98 for adjusting the tension is formed through tension supplying means such as a spring to maintain a constant tension of the transfer belt 5 and is grounded through a contact material 97. Further, the electrical resistance values of these resistors are set in such a manner that $R1 > R2$, or preferably $R1 > 10 \cdot R2$. If this advantage is to be further enhanced, the transfer belt 5 is separated from the photoconductor member 1 at the time of measuring the electrical resistance in order not to be affected by the charged conditions or electrical resistance of the photoconductor member 1. According to the present embodiment, the charges imposed on the transfer belt 5 by the transfer charger 6 are prevented from leaking by way of the transport roller 14 on the one hand and the effect of the light-sensitive member 1 is eliminated on the other hand, thereby leading to the advantage of an improved measurement accuracy of the electrical resistance.

Figure 18:
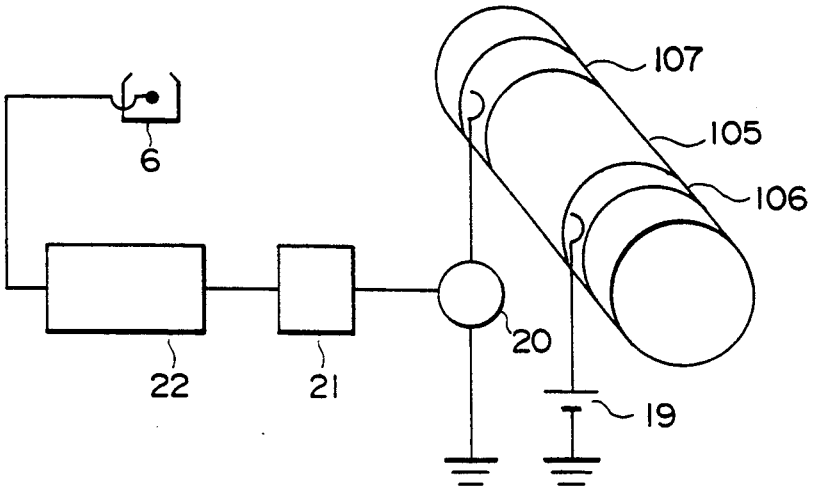
FIG. 18 is a perspective view showing still another embodiment of the present invention.

Embodiment 15:

FIG. 18 is a diagram showing a fifteenth embodiment which is a modification from the embodiment of FIG. 1. The embodiment under consideration is different from that shown in FIG. 1 in that according to the present embodiment, a transport roller 105 on paper-feed side is made of an insulating material, and a pair of conductive electrodes 106, 107 are arranged along longitudinal direction, one as a charging electrode 106 for measuring the electrical resistance, and the other as an electrode 107 for measuring the current.

A voltage is supplied to one conductive electrode 106 of the transport roller 105 by means of a bias power supply 19, and a ampere meter 20 is connected to the other conductive electrode 107. A voltage output from a control signal generator 21 to a high voltage power supply 22 is indicated on the basis of the measuring result of the ampere meter 20, and the charge is emitted from the transfer charger 6 on the basis of the output voltage.

According to the present embodiment, the surface resistance is capable of being measured without any opposite electrode 18 shown in FIG. 1, and on the basis of the measurement of surface resistance, the electrical resistance conditions of the belt are grasped, thus adding to the advantage of the ability to set a transfer current assuring a superior transfer characteristic.

The push-up roller 18 in FIG. 1 may be constructed in the manner shown in FIG. 18. Also, the means for measuring the surface resistance in FIG. 18 may be arranged together with the means for measuring the volume resistivity shown in FIG. 1 or 5.

Figure 19:
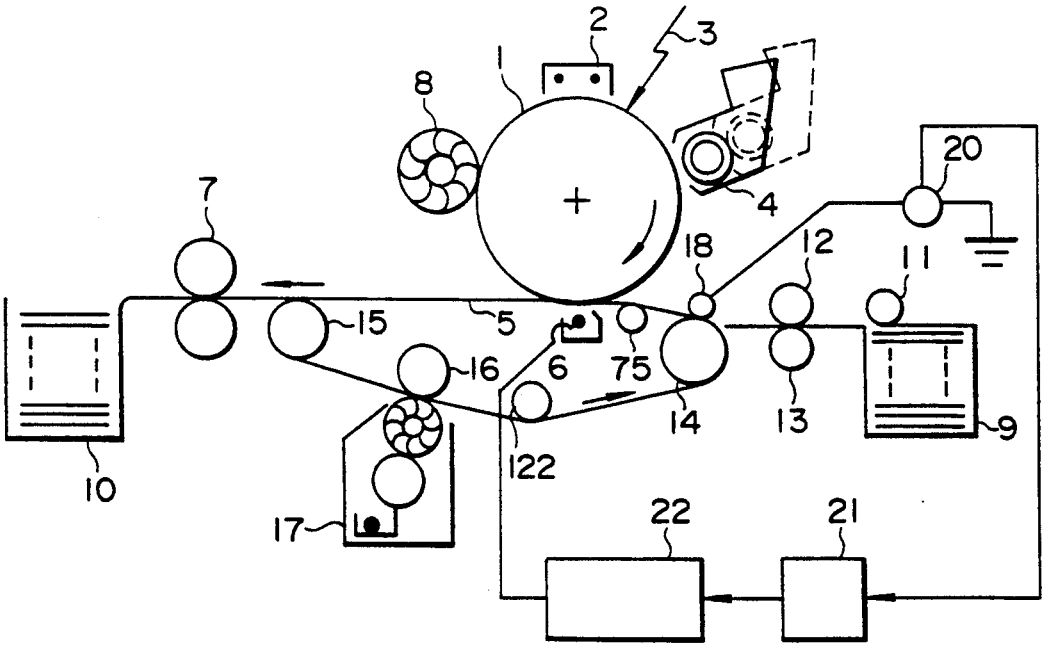

Embodiment 16:

A sixteenth embodiment of the invention is shown in the diagram of FIG. 19. According to this embodiment, unlike the embodiment of FIG. 1, a charged photoconductor member is used as a charging electrode without any power supply for measuring the electrical resistance in order to measure the current flowing into a transfer belt. Not only an opposite roller 18 held in contact with the belt surface shown in this embodiment as an electrode for measuring the incoming current, but also a push-up roller 75 held in contact with the reverse side of the belt or a bias roller 81 in FIG. 15 or the like may be used in its place. When the bias roller 81 is used, it should be held separate from a high-voltage power supply by means of a change-over switch and grounded through an ampere meter.

The present embodiment has an added advantage that there is no need of providing a new electrode for measuring the electrical resistance or a power supply for measurement. Also, during the measurement of electrical resistance, exposure means 3 is desirably set in a predetermined exposure pattern (including non-operating mode), and a developing means 4 is moved for the developer thereof out of contact with the photoconductor member (at a position indicated by a dashed line in FIG. 19, for example) in order to hold the charges and improve the measurement accuracy.

Figure 20:
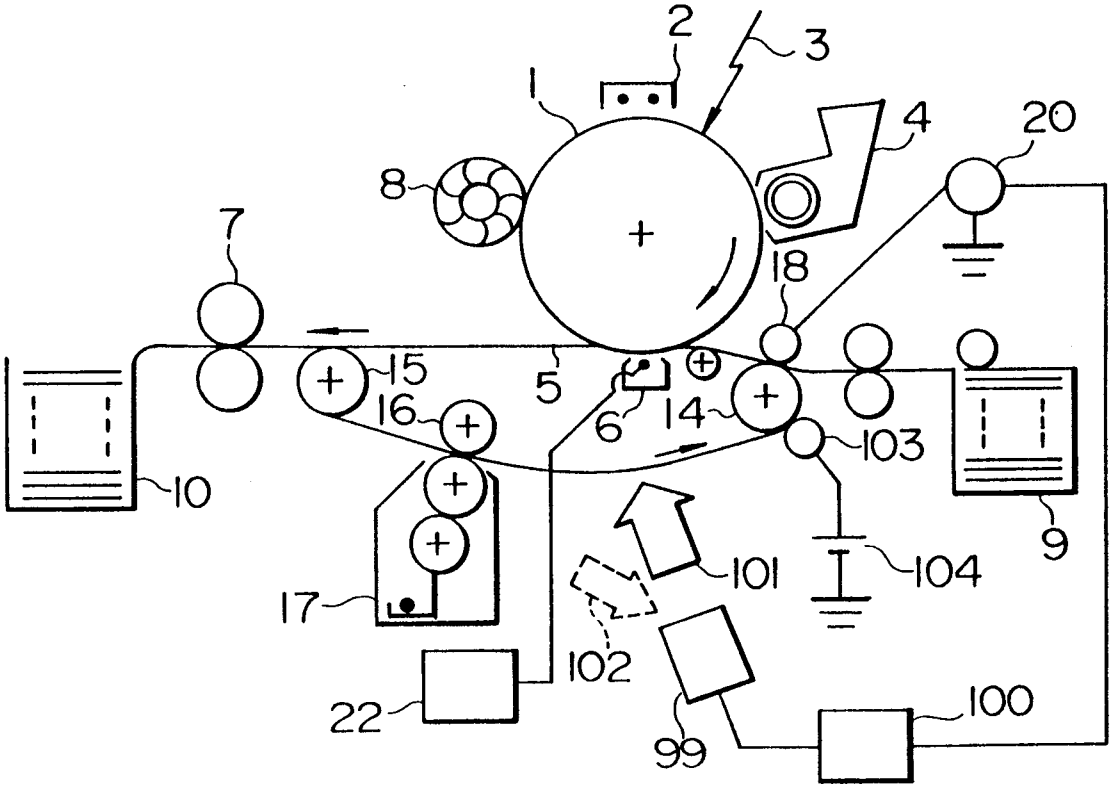

Embodiment 17:

FIG. 20 is a diagram showing a seventeenth invention of the present embodiment. According to this embodiment, the electrical resistance value of a transfer belt 5 and the paper is measured by predetermined means, and when the electrical resistance decreases below a predetermined value, resistance-restoration means 99 is energized. The resistance-restoration means 99 may be configured of any means which is capable of changing or removing the factors causing a change in electrical resistance, and may comprise, in addition to a dehumidifier device 99 shown, a far infrared ray generator or a microwave generator. According to this embodiment, as compared with the embodiments described above, the range of change in the electrical resistance value of a transfer belt 5 is reduced. In controlling the charge current of the transfer charger 6, therefore, the range of change is advantageously capable of being decreased.

Further, in the event that the electrical resistance value fails to be restored after energizing the resistance value restoration means 99 or that the electrical resistance value is reduced below a predetermined level in an apparatus lacking the resistance value restoration means 99, it is recommended that an indication be issued of the requirement of replacing the belt or output information be issued. This would lead to the advantage of preventing an omission which otherwise might be caused by a transfer failure.

After issuing the output information on the necessity of replacing the belt, subsequent operations may be reserved or the apparatus may be stopped. Further, such information may be transmitted to other devices as the output information from the electrophotographic apparatus according to the invention. As a result, other devices or systems are informed of a serious incident which may arise, thereby preventing such accident as a printing failure.

Figure 26:
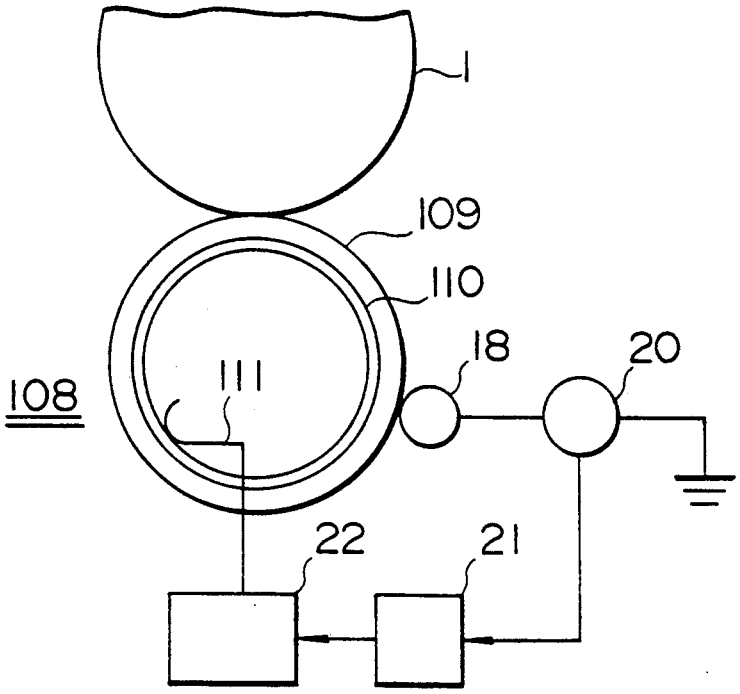
FIGS. 26 and 27 are longitudinal sectional views showing a further embodiment of the present invention.

Embodiment 18:

FIG. 26 is a diagram showing an eighteenth embodiment of the invention. This embodiment is different from the various other embodiments described above in that according to the present embodiment, a bias roll 108 is used as a charged member. The bias roll 108, which includes a cylindrical substrate 110 and an elastic member 109 covered on the outer periphery thereof, is connected to a charging high-voltage power supply electrically by a power feed brush 111. Also in this embodiment, the current value of the charging high-voltage power supply 22 is capable of being controlled on the basis of the electrical resistance of the elastic member 109, and therefore a stable transfer characteristic is assured even if the electrical resistance value of the elastic member 109 undergoes a secular variation or in dependence on the environmental conditions. Another advantage of the present embodiment resides in the fact that the whole construction of the transfer apparatus is reduced in size as compared with a case in which a belt-like member is used as a charged member.

Figure 27:
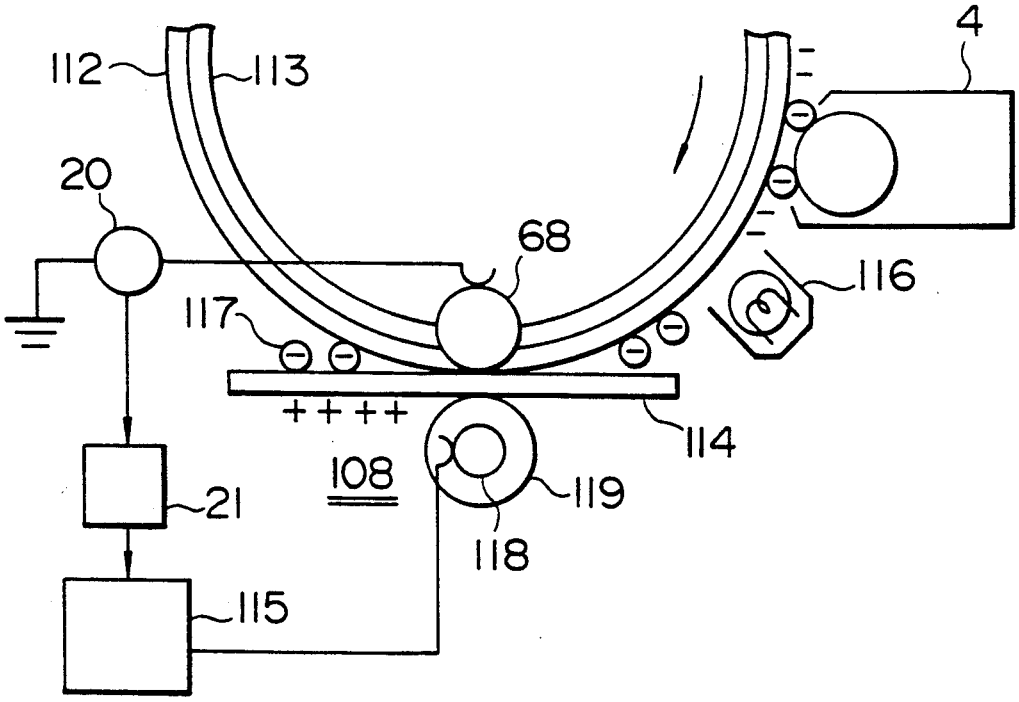
Figure 28A:
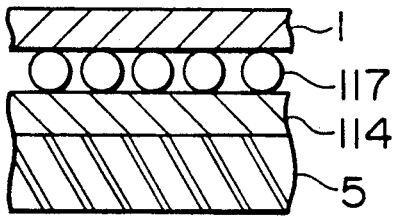
FIG. 28 is a diagram showing a model of transfer means.
Figure 28B:
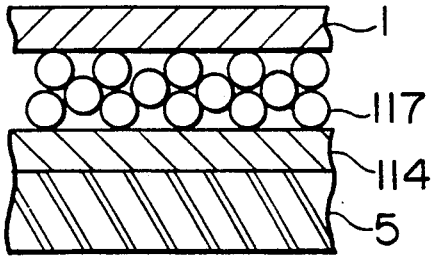

Embodiment 19:

A ninteenth embodiment of the present invention is shown in FIG. 27. The present embodiment is so configured that the electrical resistance of a bias roll 108 making up charged means and the paper 114 providing a member to which transfer is to be made is capable of being measured by the means (1) and (2) described below. And, numeral 117 indicates negatively charged toner.

(1) A disc electrode 68

(2) A charging power supply 115 which functions as a constant-current source with the current value thereof settable at the time of transfer, and operates as a voltage source at the time of measuring the electrical reistance.

Another point of difference of the present embodiment from the embodiments described above is that a light antistatic lamp 116 is interposed between the developing means 4 and the transfer means. According to the present embodiment, if a minus charge (−) exists in the unexposed portion on the photoconductor member, the plus charge (+) generated on the reverse side of the paper 114 with transfer would cause the paper to wind around the photoconductor member. Irradiation of light by the light antistatic lamp 116 could erase the charge from the surface of the photoconductor member, thus preventing the paper from winding on the photoconductor member. In order to reduce the plus charge (+) on the reverse side of the paper, an AC antistatic device may be inserted in the downstream of the bias roll 108.

Figure 29A:
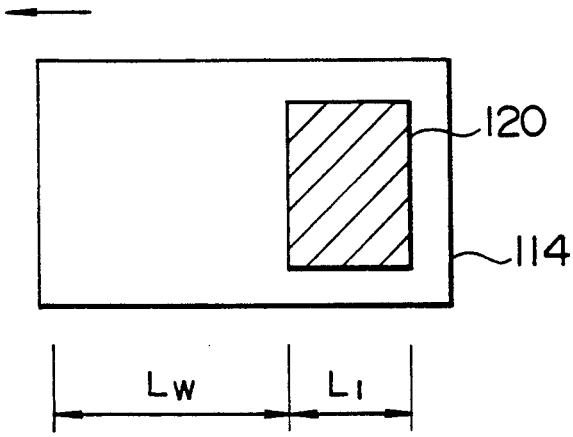
FIG. 29 is a diagram showing a model of a printing section and a non-section on the paper and a diagram for explaining a method of controlling the current of corresponding charging means.
Figure 29B:
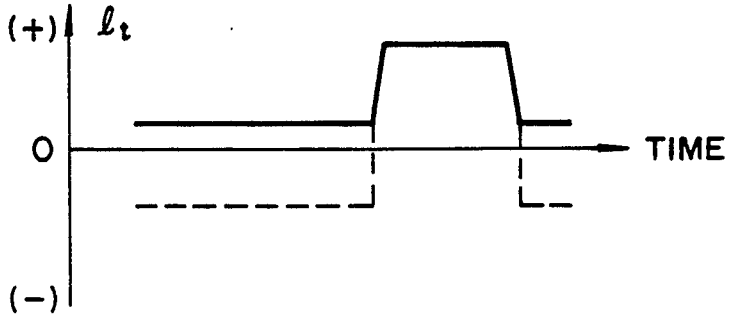

Embodiment 20:

A twentieth embodiment of the invention is shown in FIGS. 28A, 28B, 29A, and 29B, with reference to which explanation will be made about another example relating to the printing form or mode reflecting the processes to which a print has thus far been subjected. In the embodiment shown in FIG. 2, both the one- and two-side printings were explained as a printing mode. The present embodiment, on the other hand, finds the following cases (1) to (4) of application for improving the transfer characteristic and the image quality by appropriately controlling the charging means:

(1) Black toner printing and color toner printing (2) Setting of image density (3) Color printing by color superimposition with monochromatic printing (4) Blank printing The case (1) is especially effective in the case where the black toner and the color toner are different from each other in electrical resistance value. The cases (2) and (3) are based on the fact that the different amount of toner deposited as shown to FIG. 28A or FIG. 28B differentiates the optimum current value of the charging means. Also, as shown in FIG. 29A and FIG. 29B a blank is printed or in the absence of paper, the charging means is de-energized or the current thereof is reduced in value or reversed in polarity as indicated by dashed line. By doing so, the transfer of the toner remaining on the photoconductive member is prevented, thus removing the dirts from the blank portion or the toner filth which may be present on the charged member.

Further, the embodiment under consideration may use the following-described means (1) to (3):

(1) Means for indicating the current value of the charging means (2) Means for selecting one of two choices for the user, one for giving priority to the print image quality and continuing to control the current of the charging means, and the other for preferring the service life of the charged member and holding the current of the charging means within a predetermined value.

The above-mentioned means (1) and (2) makes it possible to operate an electrophotographic apparatus in line with the user needs.

(3) In the case where the conditions of the operating environments of an electrophotographic apparatus are capable of being determined in advance, or in the case where the seasonal environmental conditions can be forecast for an electrophotographic apparatus having a maintenance period, for example, the specifications of the electrical resistance value of the charged member are charged between the winter season low in humidity and the summer season high in humidity in such a manner that an apparatus with a comparatively low electrical resistance value is used when the humidity is low and an apparatus with a comparatively high electrical resistance during the season of high humidity.

In a printer for high-speed printing, the maintenance period is set normally to three to six months, and therefore different measures are capable of being taken sufficiently for each of the seasons of high and low humidities. The use of a plurality of charge members of different electrical resistance values reduces the range of the humidity conditions supported by a single type of charged member, resulting in the advantages (1) that selection and fabrication of a charged member is facilitated for a reduced production cost, and (2) that the central value of the control current for the charging means is set anew to meet the belt requirements of high and low humidity applications, with the result that the control width of the current is narrowed for an improved control accuracy and printing quality.

The transfer belt according to the present invention is preferably constructed of double layers with a fluororesin layer deposited on the surface of an elastic layer to secure an improved toner-cleaning performance, or a triple-layer structure having small secular variations due to the corona irradiation. Also, the embodiments described above may be constructed as an apparatus having the features (1) to (3) described below.

(1) A bias roll is used in place of a transfer charger to charge the transfer belt, (2) the electrical resistance is measured with a separated photoconductor member, and (3) the belt drive roller has a resistor interposed between itself and the earth in such a manner as to achieve a resistance value of $5\times10^7$ to $10^8$ Ω therebetween in order (a) to reduce the leak of the charge under high humidity, or (b) to reduce that belt deterioration by relaxing the discharge in the minor gap between the drive roller and the transfer belt in performing the antistatic operation by the belt drive roller.

Further, unlike in the reverse charging system according to the embodiments mentioned above in which the charging operation is performed from inside of the belt by a transfer charger, the present invention is of course applicable with equal effect to the front charging system in which the charging operation is carried out from outside of the belt. A double-layer belt of conductive material with a front surfce of an insulating material and a reverse surface of a conductive material is generally used as a belt material. In this case, (1) in the configuration shown in FIG. 1 (with the transfer charger 6 disposed in opposition to the drive roller 14), the members including the drive roller 15 and the opposite roller 16 in contact with the inner surface of the belt are insulated at the time of measuring the electrical resistance, or (2) the means for measuring the surface resistance shown in FIG. 18 is arranged in such a manner as to contact the outer surface of the belt.

Embodiment 21:

Further, the present invention may be used not only as a black printer but also as a transfer means for a single-drum multiple transfer color printer, a transfer means for a multi-drum color printer, a transfer means for a color printer of color superimposition type on drum or as an intermediate transfer means for a printer using an intermediate transfer member.

As explained above, according to the present invention, a stable transfer characteristic is assured even under secular variations or changes in environmental or paper conditions, thereby stabilizing the printing quality to a remarkable extent.

Now, means for achieving the second object of the present invention will be explained with reference to the embodiments described below.

Figure 30:
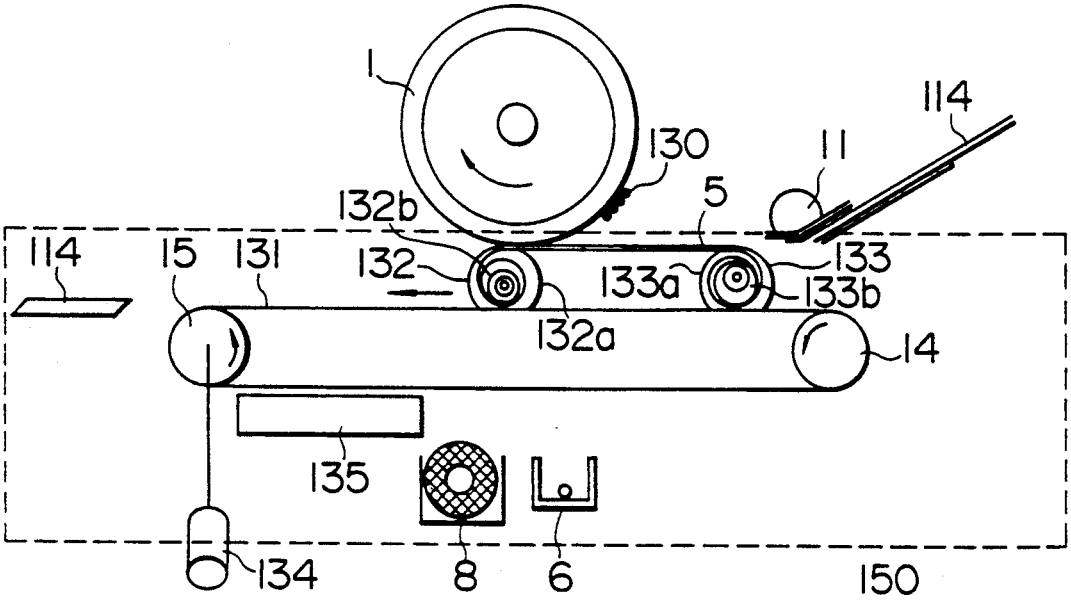
FIG. 30 is a side view showing an electrophotographic apparatus embodying the present invention.

Embodiment 22:

FIG. 30 is a side view showing an electrophotographic apparatus embodying the present invention. The outer peripheral surface of a photoconductor drum 1 has formed thereon a toner image 130 by charging, exposure and development. A transfer apparatus 150 for transferring a toner image 130 from the outer peripheral surface of the photoconductor drum 1 to the recording paper 114 comprises a drive pulley 15, an endless transport belt 131 hung around the member 14, a belt take-up means 132 and a belt supply means 133 mounted in spaced relationship with each other on the transport belt 131, a transfer belt 5 with an end thereof accommodated in the belt supply means 133 and the other end thereof taken up into the take-up means 132 and having an exposed belt portion tensioned between the belt supply means 133 and the belt take-up means 132, a renewed belt feed means 135 for renewing the exposed portion of the transfer belt rotated by being driven by the transport belt 131, a belt cleaning means 8 for cleaning the exposed portion of the transfer belt, a charging means 6 for charging the exposed portion of the transfer belt in circular motion, and a recording paper feeder means 11 for supplying the recording paper 114 to the charged exposed portion of the transfer belt for electrostatic absorption.

The drive pulley 15 is driven along the direction of arrow by the drive motor 134, whereby the transport belt 131 is driven in circular motion along the direction specified by arrow. The belt supply means 133 has a supply shaft **133*b* arranged at the center of an accommodation cylinder 133*a* having a supply slit formed therein, which shaft 133*b* accommodates the transfer belt 5 therein in a wound form. The belt take-up means 132 has a shaft 132*b* arranged at the center of the accommodation cylinder 132*a* having a take-up slit formed therein to take up the transfer belt 5 on the shaft 132*b***.

The transfer belt 5 is configured in the form of a sheet of an insulating material, and an end thereof is accommodated within the accommodation cylinder **133*a* in a form wound on the shaft 133*b* of the belt supply means 133, while the other end thereof is accommodated within the accommodation cylinder 132*a* in a form wound on the shaft 132*b* of the belt take-up means 132. The intermediate portion is exposed between the take-up means 132 and the supply means 133** to expose and transport the recording paper by electrostatic absorption.

Figure 31:
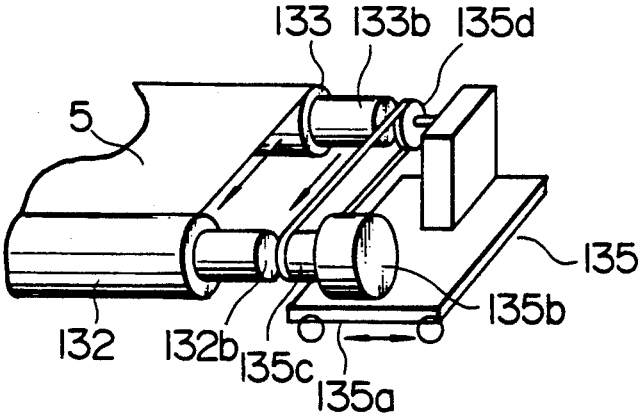
FIG. 31 is a perspective view showing a renewed belt feeding means.

The renewed belt feeding means 135, as shown in FIG. 31, has shafts **135*c*, 135*d* driven by the renewed drive motor 135*b* in opposed relationship with the shaft 132*b* of the belt take-up means 132 and the shaft 133*b* of the belt supply means 133 on the moving base 135*a*. Normally, the moving base 135*a* is retreated to set the transport belt 131 free for circular motion, while at the time of renewing the transfer belt, the moving base 135***a* is advanced to couple the two shafts at a position where the two shafts are opposed to each other, so that the two shafts are rotated by the renewal motor 135*b* to reel out an end of the transfer belt while taking up the other end thereof to perform the operation of renewing the exposed portion.

The time of the transfer belt renewal is determined with reference to the number of circular motions of the transport belt 131, so that in such a manner as to perform the renewal operation when a predetermined number of circular motions is reached, signals are supplied for controlling the drive motor 134 to drive the transport belt 131, the renewal motor 135*b* for renewed driving of the transfer belt 5 and a drive unit to move the moving base 135*a*. This time of renewal may alternatively be determined on the basis of the result or resistance measurement produced from resistance measuring means mounted on the track of circular motion for measuring the volume resistivity or surface resistance of the transfer belt.

FIG. 32 is a diagram showing the relationship of operation between the exposed portion of the transfer belt adapted to circulate with the rotation of the transport belt 131, the outer peripheral surface of the photoconductor drum 1, the belt cleaning means 8 and the charging means 6.

Figure 32A:
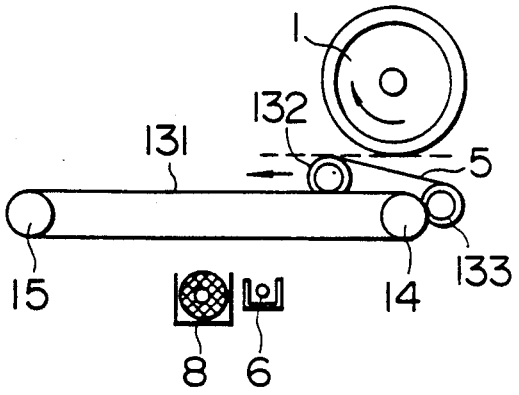
FIGS. 32A and 32B are side views showing relative operations between an exposed portion of the transfer belt and the outer peripheral surface of a photoconductor drum rotating with the circular motion of a transport belt and between belt cleaning means and charging means, respectively.
Figure 32B:
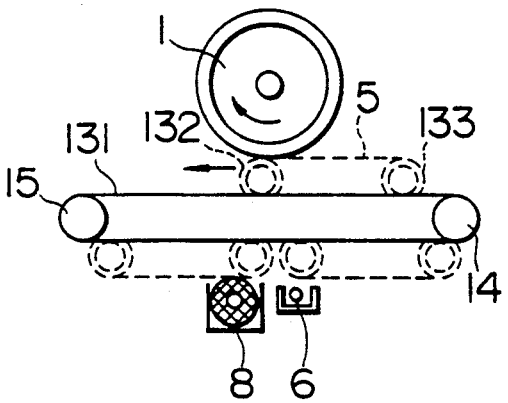

When the exposed portion of the transfer belt passes the position opposed to the photoconductor drum 1, the cleaning means 8 and the charging means 6, it is necessary that these parts have a fixed relative distance from each of the exposed portions of the transfer belt 5. As shown in FIG. 32A, for instance, assume that the belt take-up means 132 advances beyond the position of the photoconductor drum 1 when the belt supply means 133 is positioned below the top on the outer periphery of the drive pulley 14. The exposed portion of the transfer belt could not come into contact with the surface of the photoconductor drum. Under this hypothetical condition, a normal function of transfer of a toner image would become impossible. In the case where the exposed portion of the transfer belt 5 reaches a position facing the photoconductor drum 1, therefore, as shown in FIG. 32B, the drive pulley 14 is required to be set to such a position that the transfer belt 5 is in parallel to the transport belt 131. This consideration is necessary also for holding the cleaner means 8, the charging means 6 and the transfer belt 5 in fixed relative positions. In other words, when the transport belt 131 is tensioned in horizontal way, then the horizontal distance from the central point of the photoconductor drum 1 to that of the drive pulley 14 is required to be equal to or longer than the length of the exposed portion of the transfer belt 5. This also applies to the horizontal distance from the central position of the cleaner means 8 to that of the drive pulley 15 and from the terminal position of the charging means 6 to the central position of the drive pulley 14.

Figure 33A:
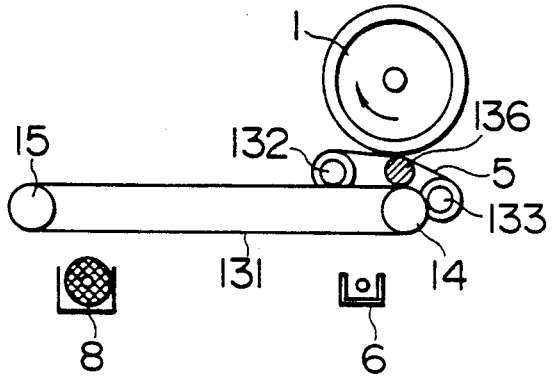
FIGS. 33A to 33D are side views showing a second embodiment of the transfer belt drive means.
Figure 33B:
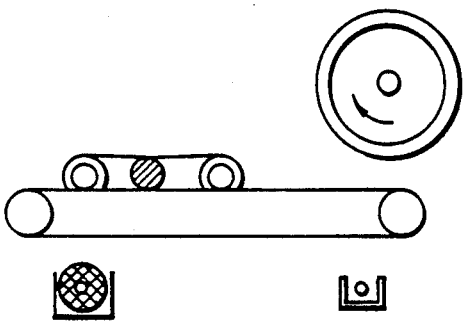
Figure 33C:
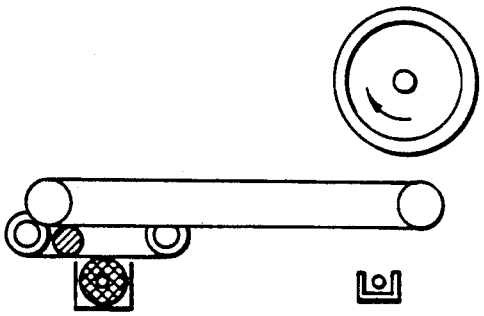
Figure 33D:
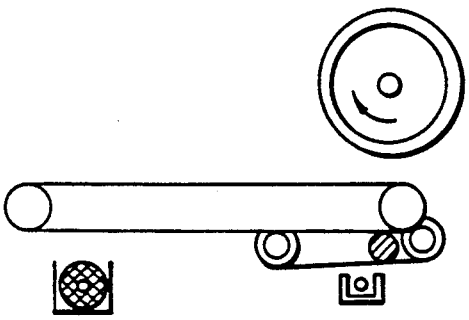

Embodiment 23:

FIGS. 33A to 33D are diagrams showing a second embodiment of the invention as modified from the first embodiment described above. According to this embodiment, a correcting roll 136 of following type adapted for circular motion along an independent track rail is inserted between the belt take-up means 132 and the belt supply means 133 in a form not fixed on the transport belt 131 or the transport belt 5. The correcting roll 136, in an apparatus intended for a reduced size by shortening the horizontal portion of the transport belt 131 with the photoconductor drum 1 arranged in the vicinity of the drive pulley 14, is operated to stop as shown in FIG. 33A with the exposed portion of the transfer belt 5 pressed against the outer peripheral surface of the photoconductor drum 1 when the belt supply means 133 circulates along the outer periphery of the drive pulley 14; is adapted to circulate together with the transfer belt 5 as shown in FIG. 33B when the belt take-up means 132 and the belt supply means 133 go around the horizontal portion of the transport belt 131; is adapted to stop as shown in FIG. 33C as the exposed portion of the transfer belt 5 is pressed against the cleaning means 8 when the belt supply means 133 circulates along the outer periphery of the drive pulley 15; and is adapted to have the start and stop operation thereof controlled as shown in FIG. 33(D) as the exposed portion of the transfer belt 5 is opposed in spaced relationship to the charging means 6 when the belt supply means 133 circulates along the outer periphery of the drive pulley 14. For the purpose of this circulating operation of the correcting roll 136, a drive system is provided independent of the transport belt 131.

Figure 34:
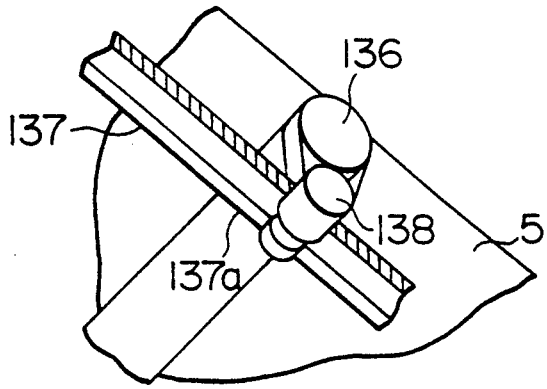
FIG. 34 is a perspective view showing a drive system for driving a correcting roll in rotative operation.

FIG. 34 shows a drive system for driving the correcting roll 136 into a circulating motion.

The track rail 137 is arranged along the transport belt 131 independently thereof. This track rail 137 is held between the power system 138 and the correcting roll 136, and the power system 138 is rotated in response to a control signal received from a slide feed rail 137*a* formed at a part of the track rail 137 thereby to move the correcting roll 136 in the manner described above.

According to this embodiment, the correcting roll 136 is capable of being moved along the transport belt 131, and therefore the track form of the transport belt 131 is capable of being set freely.

Figure 35A:
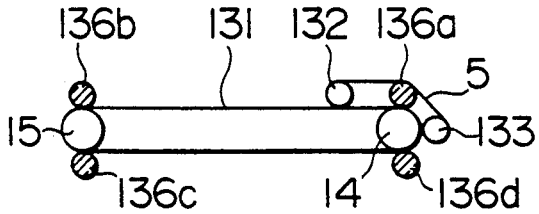
FIGS. 35A and 35B are a side view and a perspective view respectively showing a modification of the correcting roll.
Figure 35B:
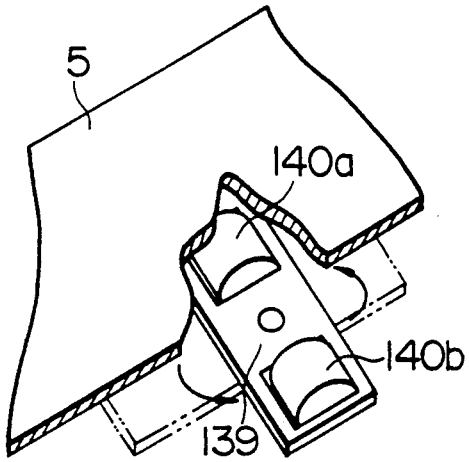

Embodiment 24:

In this embodiment, a plurality of correcting rolls performing the same function as the correcting roll 136 in Embodiment 23 described with reference to FIG. 33 are located at predetermined positions corresponding to the drive pulleys 14, 15. These correcting rolls, as shown by reference numerals 136*a*, 136*b*, 136*c*, 136*d* in FIGS. 35A, are placed at positions above and below the drive pulleys 15, 14 respectively. Each correcting roll, as shown in FIG. 35B, includes rotors 140*a*, 140*b* in a horizontally rotatable base 139, and is arranged at a position corresponding to ends along the width of the transport belt 131. With the arrival of the belt take-up means 132 and the belt supply means 133, each correcting roll is rotated into a position parallel to the edge of the transport belt (shown by dashed line) in a manner not to prevent the passage of the belt take-up means 132 and the belt supply means 133.

Embodiment 25:

The embodiments described above are all such that a single transfer belt 5 is circulated. When it is desired to shorten the intervals of transport of the recording paper for high-speed recording, however, a plurality of transfer belts are preferably arranged around the transport belt 131.

Figure 36:
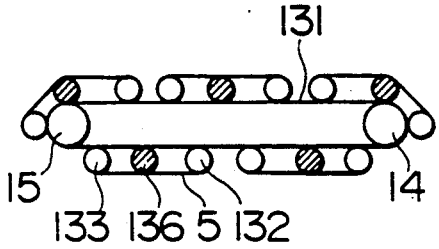
FIGS. 36 and 37 are side views showing modifications of the transfer belt.

The present embodiment, as shown in FIG. 36, has five sets of a transfer belt 5 and a correcting roll 136 arranged around the transport belt 131.

Figure 37:
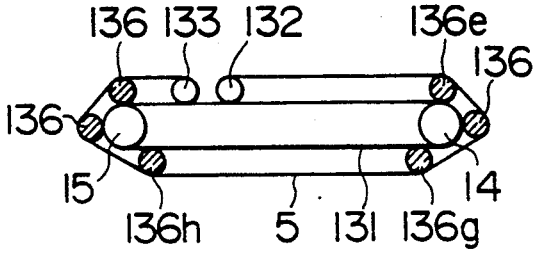

Embodiment 26:

According to this embodiment, as shown in FIG. 37, the exposed portion of a transfer belt 5 is lengthened and arranged to cover substantially the entire periphery of the transport belt 131, with the shape of circulation corrected by a plurality of correcting rolls 136*e*, 136*f*, 136*g*, 136*h*, 136*i*, 136*j*.

Figure 38A:
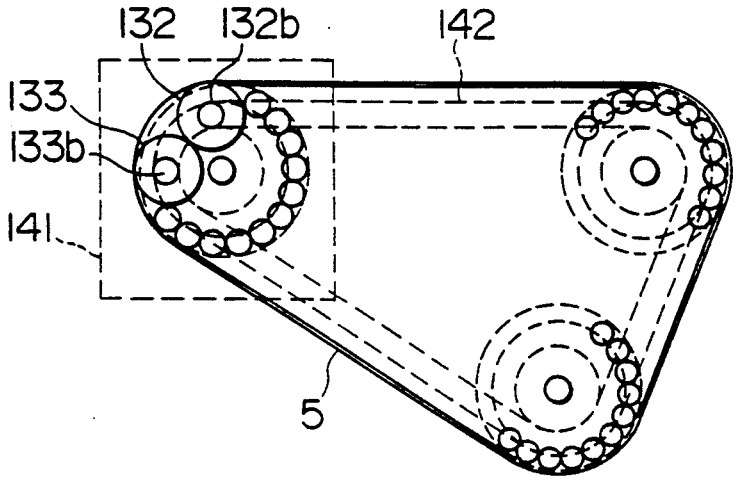
FIGS. 38A and 38B are a side view and a perspective view respectively of a modification of the transfer belt and the drive pulley respectively.

Embodiment 27:

Apart from the embodiments described above in which the transport belt 131 is rotated to circulate the transfer belt 5 together with the belt take-up means 132 and the belt supply means 133, the transfer belt 5 may be given a turning effort of its own. According to the embodiment under consideration, as shown in FIG. 38A, three drive pulleys 141 for attaching a turning effort to the transfer belt have hung therearound the exposed portion of the transfer belt 5. The circulation track of the shafts 132*b*, 133*b* of the belt take-up means 132 and the belt supply means 133 are controlled by a guide rail 142.

Figure 38B:
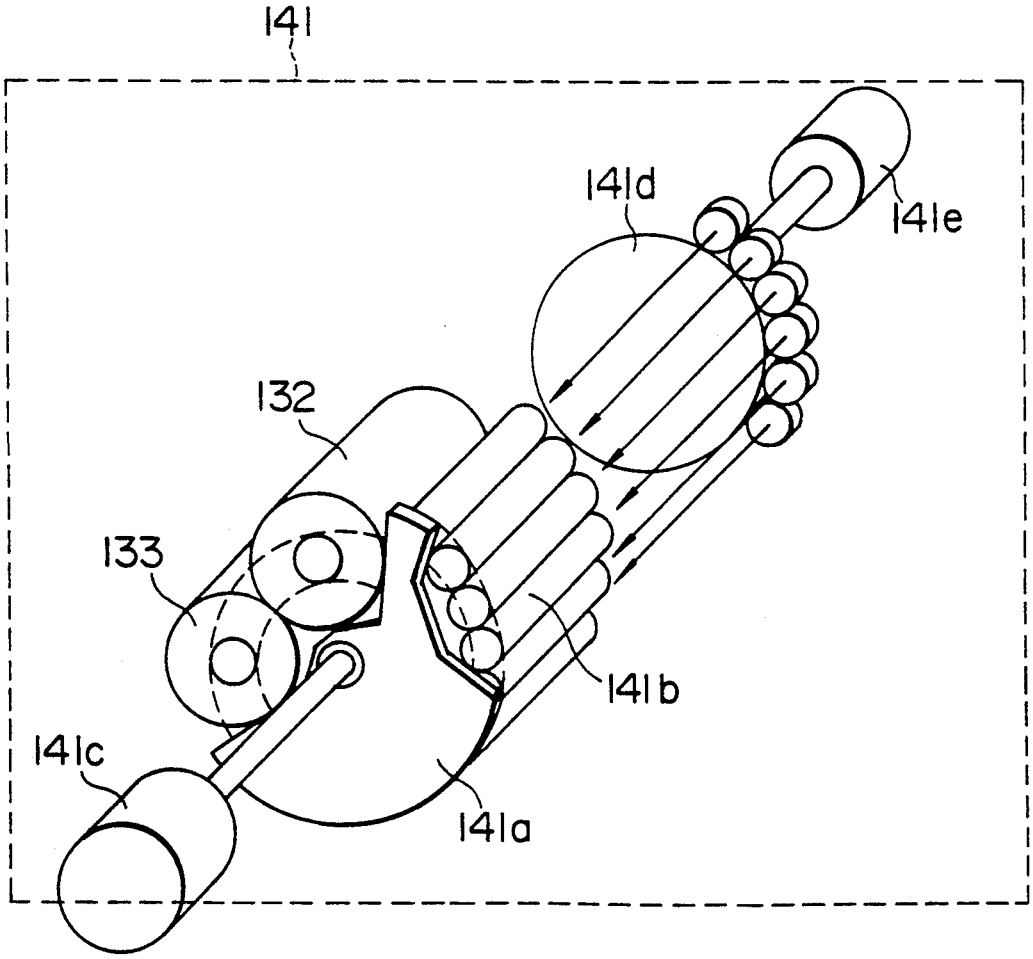

Each drive pulley 141, as shown in FIG. 38B, includes a multiplicity of small pulleys 141*b* rotatably arranged around the peripheral edge of a holding disc 141*a* at positions other than the area accommodating the belt take-up means 132 and the belt supply means 133, a first drive motor 141*c* for rotating or stopping the holding disc 141*a*, and a second drive motor 141*e* for rotating the small pulleys 141*b* through a circular disc 141*d*.

The transfer belt 5 is hung around in contact with the outer periphery of the small pulleys 141*b*, and is given the turning effort as each of the small pulleys 141*b* is rotated by the second drive motor 141*e*. When the belt take-up means 132 and the belt supply means 133 pass the position of the drive pulley 141, the first drive motor 141*c* rotates the holding disc 141*a* thereby to pass by accommodating the belt take-up means 132 and the belt supply means 133 in the area lacking the small pulleys 141*b*. Subsequently, the transfer belt 5 is circulated by rotating the small pulleys 141*b* again.

Embodiment 28:

In each of the embodiments described above, emphasis is placed on the transfer belt 5. Such a circulating belt means, however, is also applicable to means for circulating a photoconductor belt to form a static latent image in electrophotography. In such a case, the transfer belt 5 is repalced by a belt of photoconductive material or a belt of conductive material with the surface thereof covered by a photoconductive material. By using this belt in the same manner as the light-sensitive drum 1, an electrophotographic apparatus is obtained which can be used while easily renewing a photoconductor surface.

As described above, according to the present invention, the exposed portion of a belt tensioned between belt take-up means and belt supply means is moved along a specific track together with the belt take-up means and belt supply means. The exposed belt portion tensioned between the belt supply means and the belt take-up means may be, if deteriorated, taken up into the take-up means while at the same time exposing an unused belt portion between the belt supply means and the belt take-up means from inside the belt supply means. In this way, a used belt portion (exposed portion) is renewable in the same manner as if replaced, thereby assuring an effective operation for an extended period without any replacement.

We claim:

1. In an electrophotographic device including an image holding member, from which an image is transferred to a target member, a transfer apparatus comprising:

a) a charged member, said charged member
  i) adapted to hold said target member between itself and said image holding member, and
  ii) having an electrical resistance;
b) a charger adapted to charge said charged member by providing a current;
c) a measuring device adapted to measure said electrical resistance of said charged member; and
d) a controller adapted to control said current provided by said charger based on said electrical resistance of said charged member measured by said measuring device.

2. The transfer apparatus of claim 1 further comprising a circuit adapted to generate an error signal based on said electrical resistance of said charged member measured by said measuring device and being connected to said controller.

3. The transfer apparatus of claim 1 further comprising an output device adapted to generate output data based on said electrical resistance of said charged member measured by said measuring device and being connected to said controller

4. The transfer apparatus of claim 1 wherein said measuring device is adapted to independently measure said electrical resistance of said charged member at an area of said charged member passing through a transfer position.

5. An electrophotographic apparatus comprising:

an image holding member on which an image is formed; and a transfer apparatus including charging means, a member charged by the charging means, and an object member to which the image is transferred, the object member being interposed between the charged member and the image holding member, memory means for accumulating the historical data on the change in electrical resistance of said charged members, and means for controlling the charging means on the basis of the data thus accumulated.

6. An electrographic apparatus comprising:

an image holding member on which an image is formed;

a transfer apparatus including charging means, a member charged by the charging means, and an object member to which the image is transferred, the object member being interposed between the charged member and the image holding member; and a circuit for generating an error signal on the basis of the electrical resistance value of the charged member.

7. An electrographic apparatus comprising:

an image holding member on which an image is formed;

a transfer apparatus including charging means, a member charged by the charging means, and an object member to which the image is transferred, the object member being interposed between the charged member and the image holding member; and output means for producing information on the charged member on the basis of the electrical resistance of the charged member.

8. In an electrophotographic device including an image holding member, from which an image is transferred to a target member, a transfer apparatus comprising:

a) a charged member, said charged member
i) adapted to hold said target member between itself and said image holding member, and
ii) having an electrical resistance;
b) a charger adapted to charge said charged member by providing a current;
c) means for measuring an operation time of said charger;
d) a measuring device adapted to measure said electrical resistance of said charged member; and
e) a controller adapted to control said current provided by said charger based on a forecast of said electrical resistance of said charged member, wherein said forecast is determined from at least one of a charge amount which equals the product said measured charging time and said current of said charger and said charging time measured by said means for measuring.

9. The transfer apparatus of claim 8 further comprising
f) a second measuring device adapted to measure environmental conditions, wherein said forecast is further determined by said environmental conditions measured by said second measuring device.

10. In an electrophotographic device including an image holding member, from which an image is transferred to a target member, a transfer apparatus comprising:
a) a charged member, said charged member
i) adapted to hold said target member between itself and said image holding member, and
ii) having an electrical resistance;
b) a charger adapted to charge said charged member by providing a current;
c) means for measuring an operation time of said charger;
d) a measuring device adapted to measure said electrical resistance of said charged member; and
e) a controller adapted to control said current provided by said charger based on a forecast of said electrical resistance of said charged member, wherein said forecast is determined from said operation time measured by said means for measuring.

11. The transfer apparatus of claim 10 further comprising
f) a second measuring device adapted to measure environmental conditions, wherein said forecast is further determined by said environmental conditions measured by said second measuring device.

12. In an electrophotographic device having a plurality of printing modes and including an image holding member, from which an image is transferred to a target member, a transfer apparatus comprising:
a) a charged member, said charged member
i) adapted to hold said target member between itself and said image holding member, and
ii) having an electrical resistance;
b) a charger adapted to charge said charged member by providing a current;
c) a printing mode detector adapted to detect one of said plurality of printing modes; and
d) a controller adapted to control said current provided by said charger based on said printing mode.

13. The transfer apparatus of claim 12 wherein said plurality of printing modes include one-sided printing and two-sided printing.

14. In an electrophotographic device having a plurality of printing modes and including an image holding member, from which an image is transferred to a target member, a transfer apparatus comprising:
a) a charged member, said charged member
i) adapted to hold said target member between itself and said image holding member, and
ii) having an electrical resistance;
b) a charger adapted to charge said charged member by providing a current;
c) a printing mode detector adapted to detect one of said plurality of printing modes; and
d) a controller adapted to control said current provided by said charger based on said printing mode;

wherein said plurality of printing modes include monochromatic printing and multi-colored printing.

15. In an electrophotographic device having a plurality of printing modes and including an image holding member, from which an image is transferred to a target member, a transfer apparatus comprising:
a) a charged member, said charged member
i) adapted to hold said target member between itself and said image holding member, and
ii) having an electrical resistance;
b) a charger adapted to charge said charged member by providing a current;
c) a printing mode detector adapted to detect one of said plurality of printing modes; and
d) a controller adapted to control said current provided by said charger based on said printing mode;

wherein said plurality of printing modes include an image printing area mode and a no image printing area mode.

16. In an electrophotographic device having a plurality of printing modes and including an image holding member, from which an image is transferred to a target member having a thickness, a transfer apparatus comprising:
a) a charged member, said charged member
i) adapted to hold said target member between itself and said image holding member, and
ii) having an electrical resistance;
b) a charger adapted to charge said charged member by providing a current;
c) a detector adapted to detect said thickness of said target member; and
d) a controller adapted to control said current provided by said charger based on said thickness of said target member detected by said detector.

17. In an electrophotographic device having a plurality of printing modes and including an image holding member, from which an image is transferred to a target member, a transfer apparatus comprising:
a) a charged member, said charged member
i) adapted to hold said target member between itself and said image holding member, and
ii) having an electrical resistance;
b) a charger adapted to charge said charged member by providing a current;
c) means for measuring an operation time of said charger;
d) a measuring device adapted to measure said electrical resistance of said charged member;
e) a detector for detecting one of said plurality of printing modes; and
f) a controller adapted to control said current provided by said charger based on a forecast of said electrical resistance of said charged member.

wherein said forecast is determined from said operation time measured by said means for measuring and from said one of said plurality of printing modes detected by said detector.

18. In an electrophotographic device including an image holding member, from which an image is transferred to a target member, a transfer apparatus comprising:

a) a charged member, said charged member
   i) adapted to hold said target member between itself and said image holding member, and
   ii) having an electrical resistance;
b) a charger adapted to charge said charged member to one of a number of different electrical resistances by providing a current;
c) a selector; and
d) a controller adapted to control said current provided by said charger so that said electrical resistance of said charged member to one of said number of said different electrical resistances based on one of time of year or ambient operating conditions selected by said selector.

19. In an electrophotographic device including an image holding member, from which an image is transferred to a target member, a transfer apparatus comprising:

a) a charged member, said charged member
   i) adapted to hold said target member between itself and said image holding member, and
   ii) having an electrical resistance;
b) a restorer adapted to restore said electrical resistance of said charged member to at least a predetermined value;
c) a measuring device adapted to measure said electrical resistance of said charged member; and
d) a controller adapted to activate said restorer when said electrical resistance of said charged member measured by said measuring device is less than said predetermined value.

20. The transfer apparatus of claim 19 wherein said restorer is a dehumidifier.

21. The transfer apparatus of claim 19 wherein said restorer is a far infrared ray generator.

22. The transfer apparatus of claim 19 wherein said restorer is a microwave generator.

* * * * *

UNITED STATES PATENT AND TRADEMARK OFFICE

CERTIFICATE OF CORRECTION

PATENT NO. : 5,291,253

DATED : March 1, 1994

INVENTOR(S) : Takao Kumasaka et al

It is certified that error appears in the above-indentified patent and that said Letters Patent is hereby corrected as shown below:

Column 12, line 48, after "29B" insert --, when--.

Column 15, line 28, after "belt" insert --5--.

Signed and Sealed this

Thirtieth Day of August, 1994

*Attest:*

*Attesting Officer*

Bruce Lehman

BRUCE LEHMAN

*Commissioner of Patents and Trademarks*